US010102836B2

(12) United States Patent
Mintz et al.

(10) Patent No.: US 10,102,836 B2
(45) Date of Patent: Oct. 16, 2018

(54) APPARATUS, SYSTEMS, AND METHODS FOR MUSIC GENERATION

(71) Applicant: Harmonix Music Systems, Inc., Boston, MA (US)

(72) Inventors: Jonathan Mintz, Cambridge, MA (US); Eric J. Brosius, Arlington, MA (US); Paul Burrowes, Woburn, MA (US); Michael Fitzgerald, Cambridge, MA (US); Alexander Rigopulos, Belmont, MA (US)

(73) Assignee: HARMONIX MUSIC SYSTEMS, INC., Boston, MA (US)

( * ) Notice: Subject to any disclaimer, the term of this patent is extended or adjusted under 35 U.S.C. 154(b) by 0 days.

(21) Appl. No.: 15/386,825

(22) Filed: Dec. 21, 2016

(65) Prior Publication Data

US 2017/0186411 A1 Jun. 29, 2017

Related U.S. Application Data

(60) Provisional application No. 62/387,436, filed on Dec. 23, 2015.

(51) Int. Cl.
*G10H 1/00* (2006.01)
*A63F 1/00* (2006.01)
(Continued)

(52) U.S. Cl.
CPC ..... *G10H 1/0025* (2013.01); *A63F 1/00* (2013.01); *A63F 1/04* (2013.01); *A63F 9/24* (2013.01);
(Continued)

(58) Field of Classification Search
CPC ..... G10H 1/0025; A63F 1/00
(Continued)

(56) References Cited

U.S. PATENT DOCUMENTS 3,994,500 A * 11/1976 Schow ..... A63F 3/00119 273/243
4,690,025 A * 9/1987 Hines ..... G10H 1/26 84/478

(Continued)

FOREIGN PATENT DOCUMENTS

WO WO-2015113360 A1 8/2015

OTHER PUBLICATIONS

Bumbacher, E., et al., "BeatTable: A Tangible Approach to Rhythms and Ratios", XP55325818, Conference '10, No Month Listed, 2010 (4 pages—entire document).

(Continued)

*Primary Examiner* — David Warren
(74) *Attorney, Agent, or Firm* — Wilmer Cutler Pickering Hale and Dorr LLP

(57) ABSTRACT

The present disclosure relates to an apparatus, system, and method that allow non-musicians to compose and perform a musical composition. Although some existing electronic devices can provide a virtual environment to compose and play musical sound digitally, manipulating such a virtual environment can be difficult and may require specific software expertise, as well as knowledge of music theory. The present disclosure provides a platform that facilitates the creation of a musical composition without such software expertise or knowledge of music theory. The platform models a musical composition as a simultaneous playback of one or more musical contents. The platform allows players to control or modify one or more of the plurality of musical contents to generate or synthesize a musical composition.

24 Claims, 34 Drawing Sheets

(51) Int. Cl.
*A63F 1/04* (2006.01)
*A63F 9/24* (2006.01)

(52) U.S. Cl.
CPC . *G10H 2210/105* (2013.01); *G10H 2210/125* (2013.01); *G10H 2210/151* (2013.01); *G10H 2210/381* (2013.01); *G10H 2210/565* (2013.01); *G10H 2220/145* (2013.01); *G10H 2240/211* (2013.01)

(58) Field of Classification Search
USPC ..... 84/609
See application file for complete search history.

(56) References Cited

U.S. PATENT DOCUMENTS 4,840,382 A * 6/1989 Rubin ..... A63F 3/00069 273/256
5,120,065 A * 6/1992 Driscoll ..... A63F 3/00643 273/237
5,405,153 A * 4/1995 Hauck ..... G09B 15/00 273/429
6,497,412 B1 * 12/2002 Bramm ..... A63F 9/183 273/430
6,758,475 B2 * 7/2004 Newton ..... A63F 3/00119 273/242
7,288,705 B1 * 10/2007 Nelson ..... G09B 15/02 434/178
7,655,855 B2 * 2/2010 Georges ..... G10H 1/0025 84/609
7,874,496 B2 * 1/2011 Keam ..... G06K 19/06046 235/494
8,188,356 B2 * 5/2012 Rose ..... G09B 21/003 84/447
8,283,546 B2 * 10/2012 van Os ..... G06F 17/30758 84/600
8,420,923 B1 * 4/2013 Choi ..... G10H 1/32 84/476
2003/0008694 A1 * 1/2003 Troy ..... A63F 9/183 463/1
2005/0133995 A1 * 6/2005 Walker ..... A63F 3/00 273/237
2006/0076733 A1 * 4/2006 Ritchie ..... A63F 3/00119 273/242
2009/0058002 A1 * 3/2009 Hou ..... A63F 9/06 273/156
2009/0293704 A1 * 12/2009 Neil ..... G09B 15/002 84/471 R
2009/0315257 A1 12/2009 Blumenstock et al.
2010/0004062 A1 * 1/2010 Maharbiz ..... A63F 3/00643 463/36
2014/0354565 A1 * 12/2014 Yoon ..... G06F 3/041 345/173
2015/0068387 A1 * 3/2015 Shi ..... G09B 15/023 84/471 R
2015/0095883 A1 * 4/2015 Shi ..... G06F 3/048 717/109
2017/0186411 A1 * 6/2017 Mintz ..... G10H 1/0025

OTHER PUBLICATIONS

Costanza, E., et al., "Introducing Audio D-Touch: A Tangible User Interface for Music Composition and Performance", Proc. of the 6th Int. Conference on Digital Audio Effects (DAFX-03), London, UK, pp. DAFX-1-DAFX-5, Sep. 8-11, 2003 (5 pages—entire document).
D-touch drummachine +visual www.d-touch.org, https://www.youtube.com/watch?v=tPcl2RbEaSM, published Sep. 3, 2012, accessed Dec. 6, 2016 (4 pages).
International Search Report and Written Opinion issued by the European Patent Office as Searching Authority in International Application No. PCT/US2016/068018, dated Mar. 15, 2017 (16 pages).
Jorda, S., et al., "The reacTable: Exploring the Synergy between Live Music Performance and Tabletop Tangible Interfaces", Chapter 3—The Expressive Character of Interaction, TEI'07, Baton Rouge, LA, USA, pp. 139-146, Feb. 15-17, 2007 (8 pages—entire document).
Patten, J., et al., "Audiopad: A Tag-based Interface for Musical Performance", XP-002426679, NIME—New Interface for Musical Expression, May 26, 2002, (6 pages—entire document).

* cited by examiner

APPARATUS, SYSTEMS, AND METHODS FOR MUSIC GENERATION

CROSS-REFERENCE TO RELATED APPLICATIONS

This application claims benefit of U.S. Provisional Patent Application No. 62/387,436, titled "Apparatus, Systems, and Methods for Music Synthesis," filed Dec. 23, 2015, which is herein incorporated by reference in its entirety.

FIELD OF DISCLOSURE

The present invention relates to music synthesis, and, more specifically, card games, board games and video games for synthesizing music.

BACKGROUND

Traditional music performance often require knowledge of music theory and the ability to play an instrument. For example, in order to create organized melodic sounds that would be considered "music," a performer needs to be able to play a musical instrument or at least be able to strike the instrument's "actuators" (e.g., keys of a music keyboard, strings of a stringed instrument such as a guitar). The performer also needs to play the actuators at appropriate times (e.g., in some order and timing appropriate for the time signature and tempo of the piece of music, song, or melody being played by the performer on the instrument). Therefore, playing harmonized music using musical instruments can be especially difficult for amateur instrument players.

Some electronic devices can provide a virtual environment to compose and play musical sound digitally. For example, GarageBand, developed by Apple, provides a digital audio workstation for music creation. Unfortunately, manipulating such a virtual environment can be difficult and may require specific software expertise, as well as knowledge of music theory.

SUMMARY

Some embodiments include an apparatus. The apparatus includes a processor configured to run a computer program stored in memory. The computer program is operable to cause the processor to identify an object placed on a music mix layout, retrieve, from a non-transitory memory device, a musical container associated with the detected object, wherein the musical container comprises musical content, and generate a musical composition based in part on the musical content of the retrieved musical container.

In some embodiments, the music mix layout comprises a physical music mix layout.

In some embodiments, the apparatus includes an interface coupled to a sensor system, wherein the computer program is operable to cause the processor to receive, from the sensor system, via the interface, detection information indicating a presence of the object on the music mix layout.

In some embodiments, the object comprises a passive radio element, and the sensor system comprises a radio signal detection system.

In some embodiments, the radio signal detection system is configured to determine the presence of the object based, in part, on a radio signal returned by the passive radio element of the object.

In some embodiments, the object comprises a physical card.

In some embodiments, the music mix layout comprises a virtual music mix layout.

In some embodiments, the computer program is operable to cause the processor to modify the musical composition based in part on musical contents associated with a first object.

In some embodiments, the musical content of the first object comprises a part of predetermined melody samples.

In some embodiments, the computer program is operable to cause the processor to determine a musical attribute associated with the first object, and to modify the musical composition based in part on the musical attribute.

In some embodiments, the musical attribute comprises a tempo, and the computer program is operable to modify the musical composition by time-stretching the musical composition.

In some embodiments, the musical attribute comprises a key, and the computer program is operable to modify the musical composition by transposing the musical composition.

In some embodiments, the computer program is operable to cause the processor to repeat the musical content of the object to repeat the musical composition.

Some embodiments include a method. The method includes identifying, by a music synthesis module, an object placed on a music mix layout, retrieving, from a non-transitory memory device in communication with the music synthesis module, a musical container associated with the detected object, wherein the musical container comprises musical content, and generating, by the music synthesis module, a musical composition based in part on the musical content of the retrieved musical container.

In some embodiments, the music mix layout comprises a physical music mix layout, and the method further comprises receiving, from a sensor system in communication with the music synthesis module, detection information indicating a presence of the object on the physical music mix layout.

In some embodiments, the object comprises a passive radio element, and the sensor system comprises a radio signal detection system.

In some embodiments, the method further includes modifying the musical composition based in part on musical content associated with a first object.

In some embodiments, the method further includes determining a musical attribute associated with the first object, and modifying the musical composition based in part on the musical attribute.

Some embodiments include a non-transitory computer readable medium. The non-transitory computer readable medium includes computer-executable instructions. The instructions are operable to cause a processor to identify an object placed on a music mix layout, retrieve, from a non-transitory memory device in communication with the processor, a musical container associated with the detected object, wherein the musical container comprises musical content, and generate a musical composition based in part on the musical content of the retrieved musical container.

In some embodiments, the music mix layout comprises a physical music mix layout, and the instructions are further operable to cause the processor to receive, from a sensor system in communication with the processor, detection information indicating a presence of the object on the physical music mix layout.

In some embodiments, the instructions are further operable to cause the processor to modify the musical composition based in part on musical content associated with a first object.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements. The accompanying figures are schematic and are not intended to be drawn to scale. For purposes of clarity, not every component is labeled in every figure. Nor is every component of each embodiment of the disclosed subject matter shown where illustration is not necessary to allow those of ordinary skill in the art to understand the disclosed subject matter.

DETAILED DESCRIPTION

Figure 1:
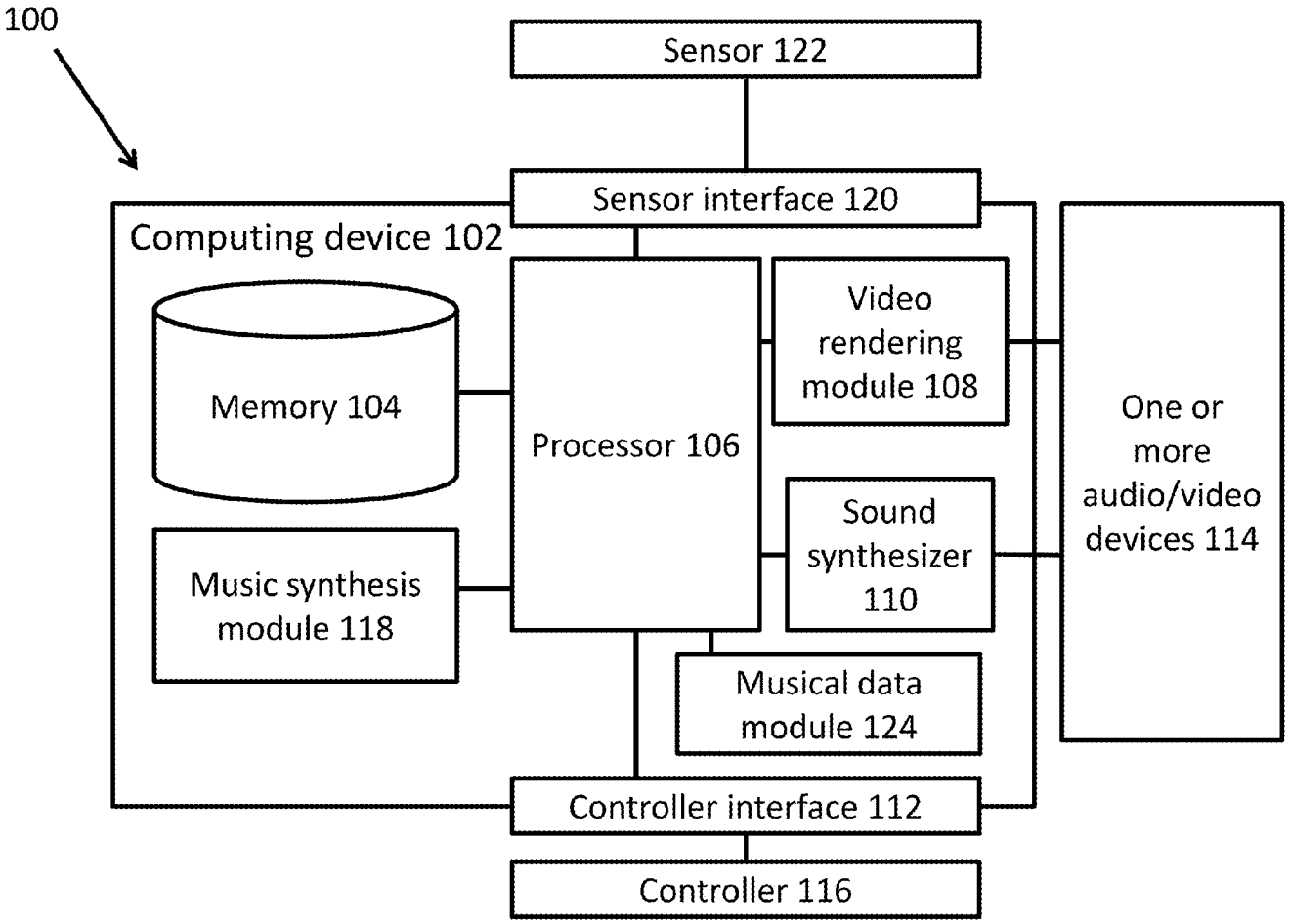
FIG. 1 is a block diagram of a platform in accordance with some embodiments.

The present disclosure relates to techniques that allow non-musicians to compose and perform a musical composition without knowledge of music theory or the ability to play an instrument. In particular, the present disclosure provides a platform, such as a synthesizing platform, card game platform (e.g., with physical cards and/or virtual cards), board game platform (e.g., with physical board game pieces and/or virtual board game pieces), video game platform, and/or the like, that facilitates the creation of a musical composition. The platform models a musical composition as a simultaneous playback of one or a plurality of musical contents. The platform allows players to control or modify one or more of the plurality of musical contents to generate or synthesize a musical composition. The platform can also allow players to modify musical attributes of the musical composition, both in parts or as a whole, throughout actions or gameplay, thereby generating a variety of musical compositions.

In some embodiments, the platform can use a musical container to represent or encode one or more parts of a musical composition. A musical container can be associated with musical content and/or a set of musical attributes. When a platform receives an indication that the player wants to use a musical container, the platform can integrate the musical content into the overall composition. When the musical container also includes a set of musical attributes, the platform can modify attributes (e.g., characteristics) of the musical content or the musical composition as a whole using the set of musical attributes from the musical container. In some cases, musical attributes can include attributes related to meter, tempo, rhythm, pitch, harmony, feel, and/or form.

In some embodiments, the musical content and/or the musical attributes associated with a musical container can be stored in a database (e.g. a table) maintained in a memory device. When a player selects a musical container for instantiation (e.g., for play), the game platform can retrieve the musical content and/or the musical attributes associated with the selected container from the database and use the retrieved container accordingly (e.g., for audible play over speakers in communication with the platform).

In some embodiments, the musical content and/or the musical attributes associated with a musical container can be stored in the musical container itself. For example, when the musical container is a physical object and includes a memory device, the memory device in the musical container can be configured to maintain the musical content and/or the musical attributes associated with the musical container.

In some embodiments, a musical container is represented by a card, such as a playing card. This enables the platform to select a particular musical container to add to the mix or track when the platform receives data indicative of a selection of the card corresponding to the particular musical container. For example, the platform can allow a player to select one of the cards in a deck of playing cards, and once the platform receives the selection, the platform or game can retrieve, from the database, the musical container associated with the selected card, and use the retrieved container.

In some embodiments, the player can select one of the cards using a computerized user interface of the platform. In other embodiments, the player can physically select one of the physical playing cards, and the platform, in turn, can detect the selection using a sensor system. The sensor system can include a radio-signal based sensor system, such as a radio-frequency identification (RFID) system and/or a near field communication (NFC) system, or a vision-based sensor system, such as a camera sensor system.

In some embodiments, the platform can model a musical composition as a combination of different types of musical contents. For example, the platform can model a musical composition as a simultaneous playback of beats, a bassline, and melody samples or tunes. The platform can generate the musical composition as each container is selected for inclusion in the composition.

A container (e.g., a card) can be associated with one of a plurality of types. In some embodiments, each type of container can be associated with a particular type of musical content. For example, a first type of container can be associated with a variety of musical beats (e.g., containers with a first color); a second type of container can be associated with a variety of basslines (e.g., containers with a second, different color); and a third type of container can be associated with a variety of melody samples (e.g., containers with a third, different color). When a player selects one or more cards, the platform can automatically play the musical contents associated with the selected cards.

In some embodiments, musical content or musical attribute(s) can be associated with (e.g., include) a part of a known song or attributes of a known song. In some embodiments, the musical content can be associated with a genre or attributes of a genre (e.g., rock, rap, and/or the like). This allows the platform to generate a mashup musical composition, such as a composition that includes parts of other songs and/or a composition that includes two genres (e.g., where one player of a game can use containers associated with a first genre, and one player can use containers associated with a second genre).

In some embodiments, the platform can be a game platform that provides a gameplay between two or more players using a music synthesis mechanism. The game platform implementing the gameplay can allow two or more players to either (1) compete with each other to create, add, take control over, and/or the like of a musical composition created by the game platform during play, or (2) collaborate with each other to create a musical composition. For example, two or more players can each hold a deck of cards in their hands. Each card can carry gameplay attributes, musical content(s) and/or a set of musical attributes. Players can take turns laying down one or more cards according to gameplay rules, scoring points and building up layers of a musical composition as the cards are played. The gameplay rules may determine not only when, where and how cards are played, but also how the cards affect, or are affected by, other cards in play, both from the gameplay and the musical point of view.

In some embodiments, the platform can be a game platform that provides a gameplay to a single player. For example, the game platform can enable a player to engage in a game play against a simulated opponent (e.g., computer). The game platform can also enable a player to create a musical composition and/or a musical performance alone.

As cards or other types of containers are played, the game platform can create an evolving musical composition in real-time. The gameplay can conclude when a predetermined condition is satisfied. The predetermined condition can be based on the number of points earned by one or more players, the number of turns taken by the players, the end of a musical form, and/or the end of a predetermined time limit. The musical composition created during the gameplay can be unique to the containers/cards played, reflecting both the cards played and the ebb and flow of the gameplay. This platform can save the created composition as a media file, such as an audio file and/or a video file, and allow players to re-listen to the composition at a later time. When the saved media file is a video file, the video file can include an illustration summarizing the containers used during the composition creation. For example, when a player creates a musical composition by using a plurality of containers for 20 minutes, the video file can be abridged into a shorter video (e.g., a 3-minute video). The abridged video can subsequently be shared with others, for example, over the network.

In some embodiments, the music synthesis module 118 can be configured to capture and store individual events that occur during the gameplay. In particular, the music synthesis module 118 can be configured to edit, reconstruct, and/or re-run these events, or subset thereof, to produce an abridged version of the gameplay. In some cases, the music synthesis module 118 is configured to produce an abridged version of the gameplay by eliminating unwanted events and/or shortening the time interval between events. In some embodiments, the music synthesis module 118 can receive an instruction to construct a "snapshot" of the current state of the music. In response, the music synthesis module 118 is configured to edit, reconstruct, and re-run one or more events that make up the snapshot.

FIG. 1 is a block diagram of a platform in accordance with some embodiments. The platform 100 can include a computing device 102. In some embodiments, the computing device 102 can be a dedicated game console, e.g., PLAYSTATION®3, PLAYSTATION®4, or PLAYSTATION®VITA manufactured by Sony Computer Entertainment, Inc.; WII™, WII U™, NINTENDO 2DS™, or NINTENDO 3DS™ manufactured by Nintendo Co., Ltd.; or XBOX®, XBOX 360®, or XBOX ONE® manufactured by Microsoft Corp. In other embodiments, the computing device 102 can be a general purpose desktop or laptop computer. In other embodiments, the computing device 102 can be a server connected to a computer network. In other embodiments, the computing device 102 can be user equipment. The user equipment can communicate with one or more radio access networks and with wired communication networks. The user equipment can be a cellular phone. The user equipment can also be a smartphone providing services such as word processing, web browsing, gaming, e-user equipment can also be a tablet computer providing network access and most of the services provided by a smart phone. The user equipment operates using an operating system such as Symbian OS, iPhone OS, RIM's Blackberry, Windows Mobile, Linux, HP WebOS, and Android. The screen might be a touch screen that is used to input data to the mobile device, in which case the screen can be used instead of the full keyboard. The user equipment can also keep global positioning coordinates, profile information, or other location information.

The computing device 102 can include a memory device 104, a processor 106, a video rendering module 108, a sound synthesizer 110, a controller interface 112, a music synthesis module 118, a sensor interface 120, and a musical data module 124. The controller interface 112 can couple the computing device 102 with a controller 116; the video rendering module 108 and the sound synthesizer 110 can connect to one or more audio/video devices 114; and the sensor interface 120 can couple the computing device 102 with a sensor 122.

The non-transitory memory 104 can maintain one or more musical containers and/or musical items associated with a container. A musical container can include musical content and/or one or more musical attributes to be associated with the musical content and/or the musical composition as a whole. The memory 104 can also maintain machine-readable instructions for execution on the processor 106.

In some embodiments, the memory 104 can take the form of volatile memory, such as Random Access Memory (RAM) or cache memory. In other embodiments, the memory 104 can take the form of non-volatile memory, including by way of example semiconductor memory devices, e.g., EPROM, EEPROM, and flash memory devices; or magnetic disks, e.g., internal hard disks or removable disks. In some embodiments, the memory 104 can include portable data storage devices, including, for example, magneto-optical disks, and CD-ROM and DVD-ROM disks.

The processor 106 can take the form of a programmable microprocessor executing machine-readable instructions, such as a computer processing unit (CPU). Alternatively, the processor 106 can be implemented at least in part by special purpose logic circuitry, e.g., an FPGA (field programmable gate array) or an ASIC (application-specific integrated circuit) or other specialized circuit. The processor 106 can include a plurality of processing units, each of which may independently operate on an input data, such as a gradient vector. In some cases, the plurality of processing units may be configured to perform an identical operation on different data. For example, the plurality of processing units can be configured in a single-instruction-multiple-data (SIMD) architecture to operate on multiple data using a single instruction. In other cases, the plurality of processing units may be configured to perform different operations on different data. For example, the plurality of processing units can be configured in a multiple-instruction-multiple-data (MIMD) architecture to operate on multiple data using multiple instructions.

The processor 106 can be coupled with a controller interface 112. The controller interface 112 can be implemented in hardware to send and receive signals in a variety of mediums, such as optical, copper, and wireless, and in a number of different protocols some of which may be non-transient.

The controller interface 112 can be coupled with an external controller 116. The external controller 116 can allow a player to interact with the computing device 102. In some embodiments, the external controller 116 can include a game console controller, a mouse, a keyboard, or any other device that can provide communication with the computing device 102. In some embodiments, the external controller 116 can also take the form of a microphone controller capable of receiving vocal input from a player.

In some embodiments, the processor 106 can be coupled to a video rendering module 108 and a sound synthesizer 110. The video rendering module 108 can be configured to generate a video display based on instructions from processor 106, while the sound synthesizer 110 can be configured to generate sounds accompanying the video display. The video rendering module 108 and the sound synthesizer 110 can be coupled to an audio/video device 114.

In some embodiments, the one or more audio/video devices 114 can include a display device, e.g., a CRT (cathode ray tube), LCD (liquid crystal display) monitor, or LED (light emitting diode) monitor, a television, an integrated display, e.g., the display of a PLAYSTATION®VITA or Nintendo 3DS, or other type of device capable of displaying video and accompanying audio sounds. While FIG. 1 shows two separate connections into the one or more audio/video devices 114, other embodiments in which the two connections are combined into a single connection are also possible. In some embodiments, one of the audio/video devices 114 can reside in a first system (e.g., a display system) and another one of the audio/video devices 114 can reside in second system (e.g., a sound system).

In some embodiments, the one or more audio/video devices 114 can include a light feedback system. The light feedback system can be configured to indicate musical attributes associated with a musical composition. For example, the light feedback system includes a plurality of lighting elements, such as LEDs having different colors, and each lighting element can be configured to indicate a particular musical attribute, such as tempo, key, or tone.

In some embodiments, the light feedback system can be built into a speaker system. The light feedback system in the speaker system can be configured to provide dynamic light and sound feedback based on the play. In other embodiments, the light feedback system can be deployed in an open space, such as a home or a public space. The light feedback system can be coupled to a communications network, and can be triggered, by the computing device 100, to provide a dynamic nightclub-style lighting that responds to the musical composition.

In some embodiments, the computing device 102 can include a sensor interface 120 that enables communication with a sensor 122. The sensor interface 120 can be implemented in hardware to send and receive signals in a variety of mediums, such as optical, copper, and wireless, and in a number of different protocols some of which may be non-transient.

In some embodiments, the sensor 122 can be configured to detect a player's selection of a musical container. For example, the sensor 122 can be configured to detect that a player has selected a card associated with a particular container stored in the memory device 104. In some embodiments, the sensor 122 can include a camera sensor, a video sensor, an infrared sensor, or any other types of visual sensors capable of detecting physical and/or visual information. In other embodiments, the sensor 122 can include a radio signal sensor, such as an RFID sensor, an NFC sensor, or any other radio signal sensors capable of detecting a presence of an object (e.g., a card) associated with a particular container stored in the memory device 104.

In some embodiments, the sensor 122 can be configured to receive data from a musical container. The musical container can include a memory device, which maintains the musical data (e.g., the Musical Instrument Digital Interface (MIDI) data) associated with the musical container. Upon receiving a trigger signal from the sensor 122, the memory device in the musical container can provide the musical data to a transmitter coupled to, or embedded in, the musical container. The transmitter can subsequently provide the musical data to the sensor 122. The sensor 122 can relay the musical data to the processor through the sensor interface 120 for further processing. In some embodiments, the memory device in the musical container can include a non-volatile memory device, such as a flash memory device. In some embodiments, the transmitter can include a radio antenna, such as a RFID tag.

In some embodiments, the computing device 102 can include a music synthesis module 118. The music synthesis module 118 can be configured to synthesize or create a musical composition using one or more musical containers and/or musical items associated with a container stored in the memory device 104. The music synthesis module 118 can also receive container selection information from the controller 116 or the sensor 122, indicating that a player has selected a particular container stored in the memory device 104. The music synthesis module 118 can be configured to generate a musical composition using all of the musical containers selected by the player. In some embodiments, the music synthesis module 118 can receive container selection information over time. In such cases, the music synthesis module 118 can generate (or update) the musical composition in real-time as the selection information comes in for each container. When two or more players perform a gameplay, the music synthesis module 118 can be configured to enforce gameplay rules and generate a musical composition in accordance with the gameplay rules.

In some embodiments, the computing device 102 can include a musical data module 124. The musical data module 124 can be configured to provide musical feedback information to the light feedback system in the one or more audio/video devices 114. For example, the musical data module 124 can receive, from the sensor interface 120, one or more musical attributes associated with a musical container. Based on the musical attributes, such as tempo, key, and/or tone, the musical data module 124 can generate musical feedback information and send the musical feedback information to the light feedback system. Once the light feedback system receives the musical feedback information, the light feedback system can display the musical feedback information. For instance, the light feedback system can periodically switch on and off one of the lighting elements at a particular frequency. The particular frequency can indicate the tempo associated with the musical container (and hence, the musical composition modified by the musical container).

In some embodiments, one or more of the modules 108, 110, 118 can be implemented in software using the memory device 104. The software can run on a processor 106 capable of executing computer instructions or computer code. The processor 106 is implemented in hardware using an application specific integrated circuit (ASIC), programmable logic array (PLA), digital signal processor (DSP), field programmable gate array (FPGA), or any other integrated circuit. The processor 106 suitable for the execution of a computer program includes, by way of example, both general and special purpose microprocessors, digital signal processors, and any one or more processors of any kind of digital computer. Generally, the processor 106 receives instructions and data from a read-only memory or a random access memory or both.

In some embodiments, one or more of the modules (e.g., modules 108, 110, 118) can be implemented in hardware using an ASIC (application-specific integrated circuit), PLA (programmable logic array), DSP (digital signal processor), FPGA (field programmable gate array), or other integrated circuit. In some embodiments, two or more modules 108, 110, 118 can be implemented on the same integrated circuit, such as ASIC, PLA, DSP, or FPGA, thereby forming a system on chip. Subroutines can refer to portions of the computer program and/or the processor/special circuitry that implement one or more functions.

The modules 108, 110, 118 can be implemented in digital electronic circuitry, or in computer hardware, firmware, software, or in combinations of them. The implementation can be as a computer program product, e.g., a computer program tangibly embodied in a machine-readable storage device, for execution by, or to control the operation of, a data processing apparatus, e.g., a programmable processor, a computer, and/or multiple computers. A computer program can be written in any form of computer or programming language, including source code, compiled code, interpreted code and/or machine code, and the computer program can be deployed in any form, including as a stand-alone program or as a subroutine, element, or other unit suitable for use in a computing environment. A computer program can be deployed to be executed on one computer or on multiple computers at one or more sites.

While the modules 108, 110, 118 are depicted as separate modules outside of processor 106 (e.g., as stand-alone graphics cards or sound cards), other embodiments are also possible. For example, one or both modules can be implemented as specialized hardware blocks within processor 106. Alternatively, one or more modules 108, 110, 118 can be implemented purely as software running within processor 106.

Figure 2A:
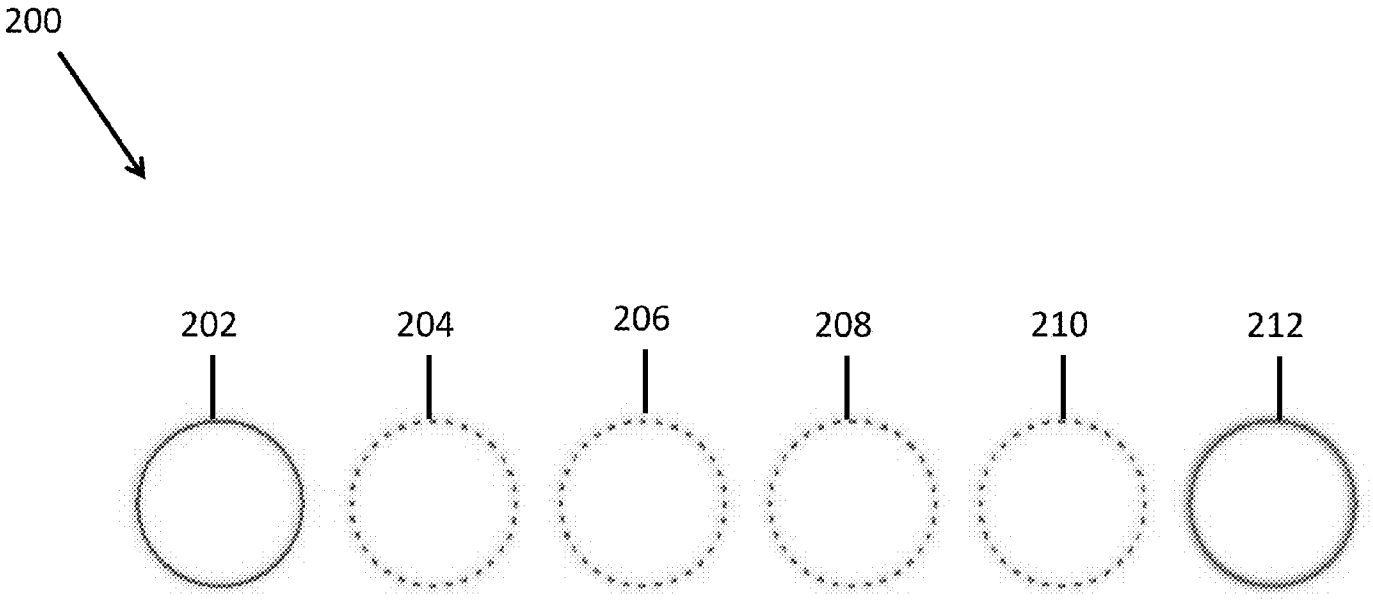
FIGS. 2A-2D illustrate a music mix layout in accordance with some embodiments.

In some embodiments, the platform 100 can be configured to interact with a music mix layout. FIG. 2A illustrates a music mix layout in accordance with some embodiments. The music mix layout 200 can include a plurality of slots, and the slots can indicate musical containers with which to generate a musical composition. Each slot can be configured to receive an object associated with a particular musical container stored in the memory device 104.

In some embodiments, one or more slots can only be associated with one or more types of object. For example, one of the slots can specify the beats of the musical composition, and can only be associated with a card corresponding to a musical container including beats attributes. As an exemplary embodiment, in FIG. 2A, a first slot 202 is associated only with beats attributes; slots 204-210 are associated with one or more musical instruments; and a second slot 212 is associated with the theme of the musical composition. In some cases, the music mix layout 200 can include a notification feature that indicates whether an object placed on a particular slot satisfies a gameplay rule. For example, when a slot is associated with the "beats" attribute, but a card associated with a guitar is placed on that slot, then the notification feature can notify the player that the card does not satisfy the gameplay rule. When there are multiple players, the notification feature can also indicate which player controls a particular slot. When the music mix layout 200 is a physical music mix layout, as disclosed below, the notification feature can be implemented using a light emitting diode (LED).

Figure 2B:
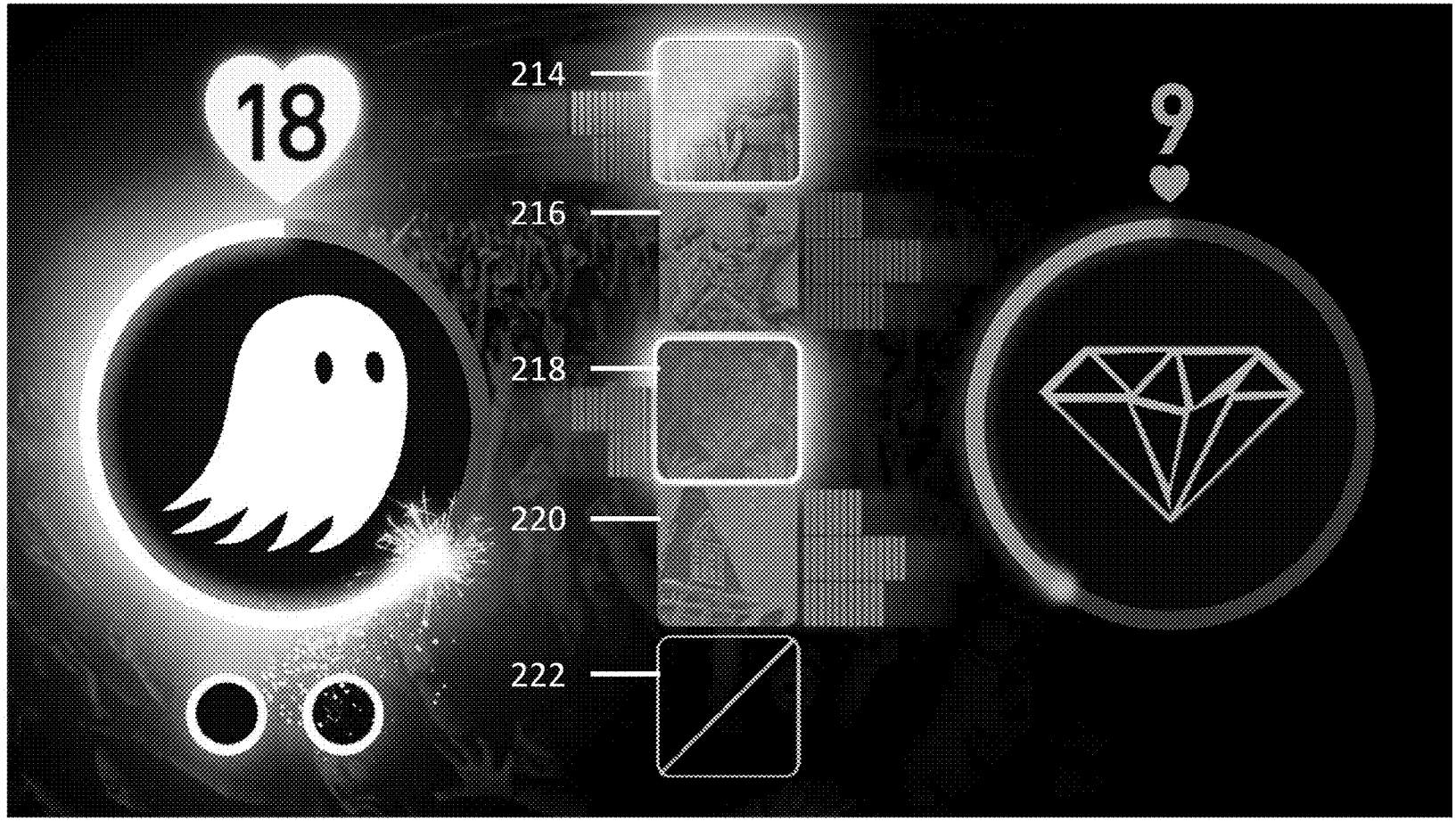

In some embodiments, the music mix layout 200 can be implemented in software. FIG. 2B shows a virtual music mix layout in accordance with some embodiments. The music mix layout can be shown virtually on a display device 114 and the player can interact with the music mix layout by placing virtual objects on one or more slots 214-222 on the virtual music mix layout using the controller 116.

Figure 2C:
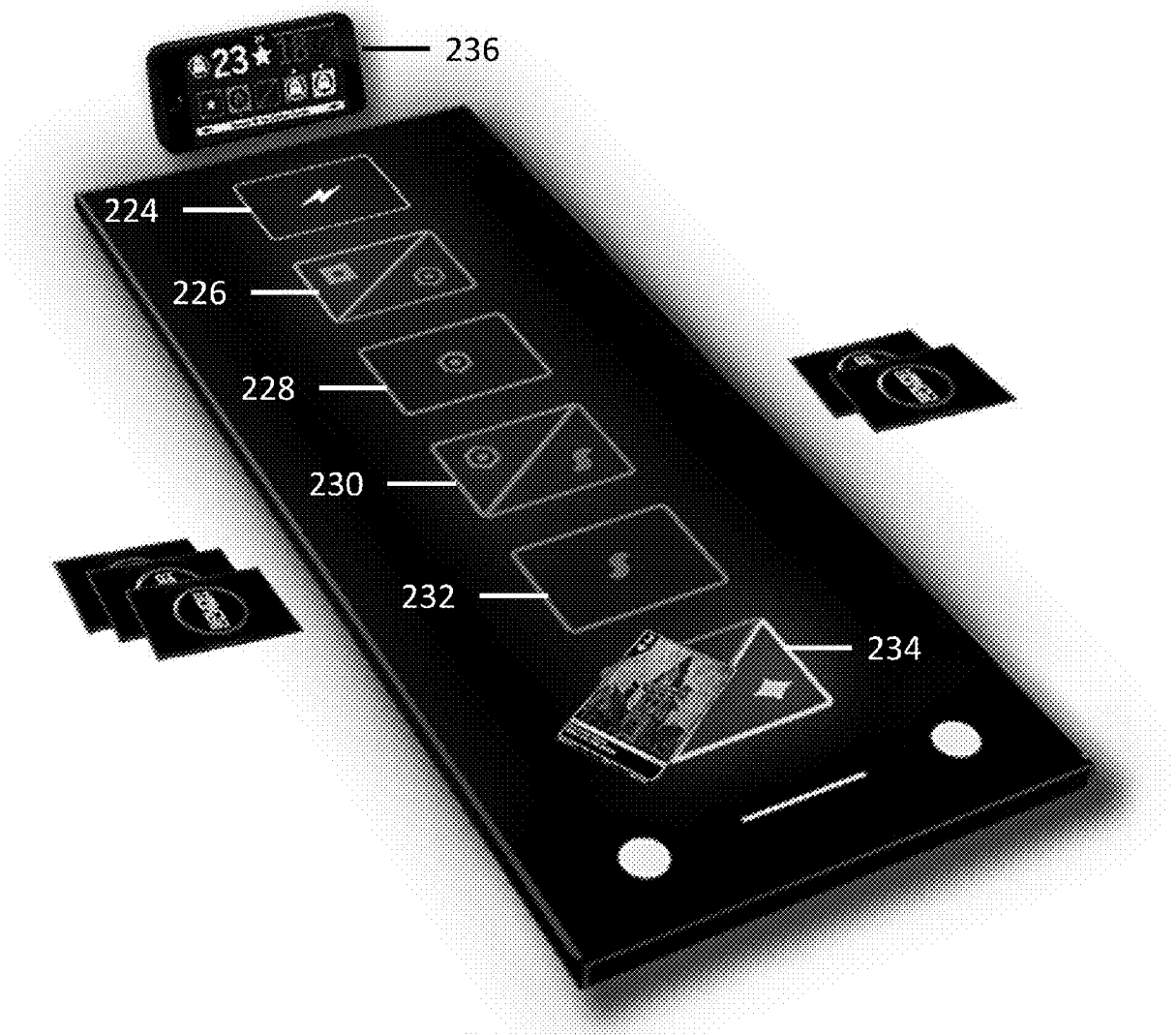

In other embodiments, the music mix layout 200 can be implemented physically. FIG. 2C illustrates a physical music mix layout in accordance with some embodiments. The physical music mix layout can include a plurality of slots 224-234 on which a container can be placed. For example, the physical music mix layout can be printed on paper, cardboard, a vinyl sheet, textile, or any other materials amenable for printing.

In some embodiments, when the music mix layout 200 is implemented physically, the computing system 102 can provide a virtual rendering of the physical music mix layout 200 and/or the containers placed thereon on the audio/video device 114. This virtual rendering can be updated periodically or in real-time as the game play progresses on the physical music mix layout.

In some embodiments, a player can physically interact with the physical music mix layout by placing physical objects (such as containers) on the physical music mix layout. For example, a player can place a playing card on the physical music mix layout to select musical containers for the musical composition. The computing system 102 can receive container selection information from the physical music mix layout using the sensor 122. For example, the sensor 122 can detect that the player has placed a card at one of the plurality of slots on the music mix layout and send selection information to the musical synthesis module 118, indicating that the card has been detected. Subsequently, the musical synthesis module 118 can generate a musical composition using the musical container associated with the detected card.

In some embodiments, the physical music mix layout can include one or more sensors 122 embedded in the physical music mix layout. For example, the physical music mix layout can include a radio sensor (e.g., an RFID sensor and/or an NFC sensor) embedded in it. The radio sensor can be capable of detecting the presence of a particular object (e.g., a playing card) associated with a particular container. In such embodiments, the objects would also include an element that would allow the radio sensor to detect their presence. For example, the objects can include a passive RFID element that would respond to active signals from the RFID sensor. In some cases, each of the slots can include an independent sensor in order to detect the presence of an object at a particular slot.

In some embodiments, the embedded sensors 122 can be configured to send container selection information to an intermediate controller 236. The intermediate controller 236 can be configured to communicate with the sensor interface 120 of the computing device 102 to provide the container selection information to the computing device 102.

In some embodiments, the intermediate controller 236 can be configured to communicate with embedded sensors 122 using a radio communication channel, such as Bluetooth. For example, when an embedded sensor 122 detects a container on the physical music mix layout, the embedded sensor 122 can send the container selection information to the intermediate controller 236 over Bluetooth. Subsequently, the intermediate controller 236 can relay the container selection information to the computing device 102 via the sensor interface 120. In some cases, the communication between the intermediate controller 236 and the sensor interface 120 can occur over a radio communication channel, such as WiFi.

Figure 2D:
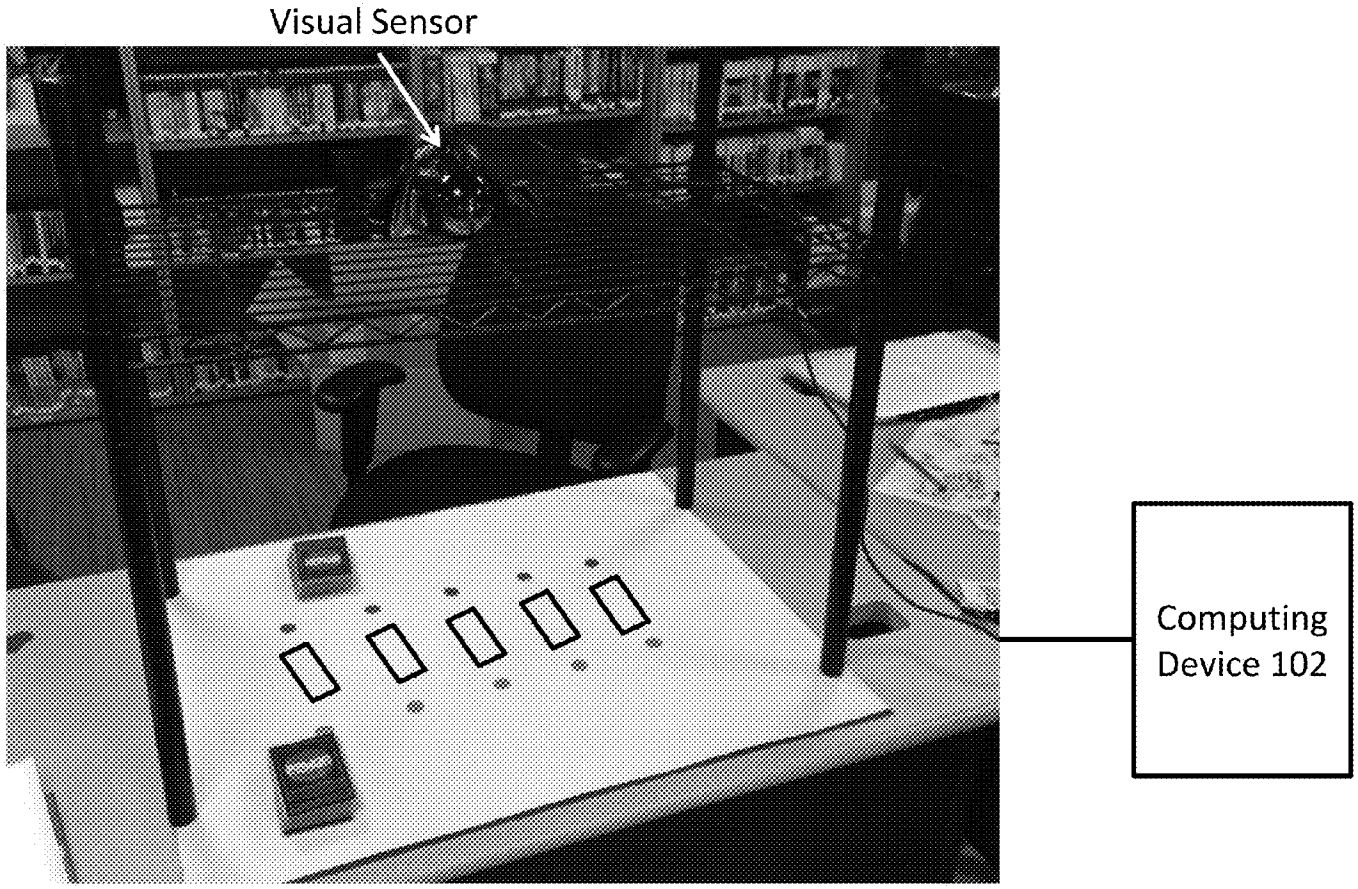

In some embodiments, the sensor 122 can include a visual sensor. FIG. 2D illustrates a visual sensor 122 coupled to a computing device 102 (e.g., the platform) in accordance with some embodiments. The visual sensor 122 can detect the presence of an object (e.g., a card) in one of the plurality of slots shown on the physical mix layout 200.

In some cases, a container can be associated with a particular type. In some embodiments, a container can be color-coded to specify the type. Different types of containers can be associated with different instruments or different musical attributes. For example, when a card has patterns with the color "blue," the card can be associated with the "beats" attributes. As another example, when a card has patterns with the color "red," the card can be associated with musical contents of a guitar. In some cases, the object can include a pattern that specifies the musical container associated with the card. For example, a card can include a barcode that specifies whether a card is associated with a musical content of "falling rain drops."

As discussed above, one or more slots on the music mix layout can only be associated with a particular type of object. In other words, one or more slots on the music mix can only receive a particular type of object. In some embodiments, the sensor 122 can be configured to detect the type of object placed on a particular slot and provide that information to the computing device 102, such as the music synthesis module 118. When the object placed on a slot is not the proper type of object for that slot, the computing device 102, such as the music synthesis module 118, can send an error signal to one or more audio/video devices 114 so that the one or more audio/video devices 114 can display or play an error sign to the user.

In some embodiments, the music mix layout can be the audio/video device 114. For example, the audio/video device 114 can display, on a display, the one or more slots of the music mix layout, and as the objects are deployed on the one or more slots, the audio/video device 114 can provide an audio effect.

Figure 3A:
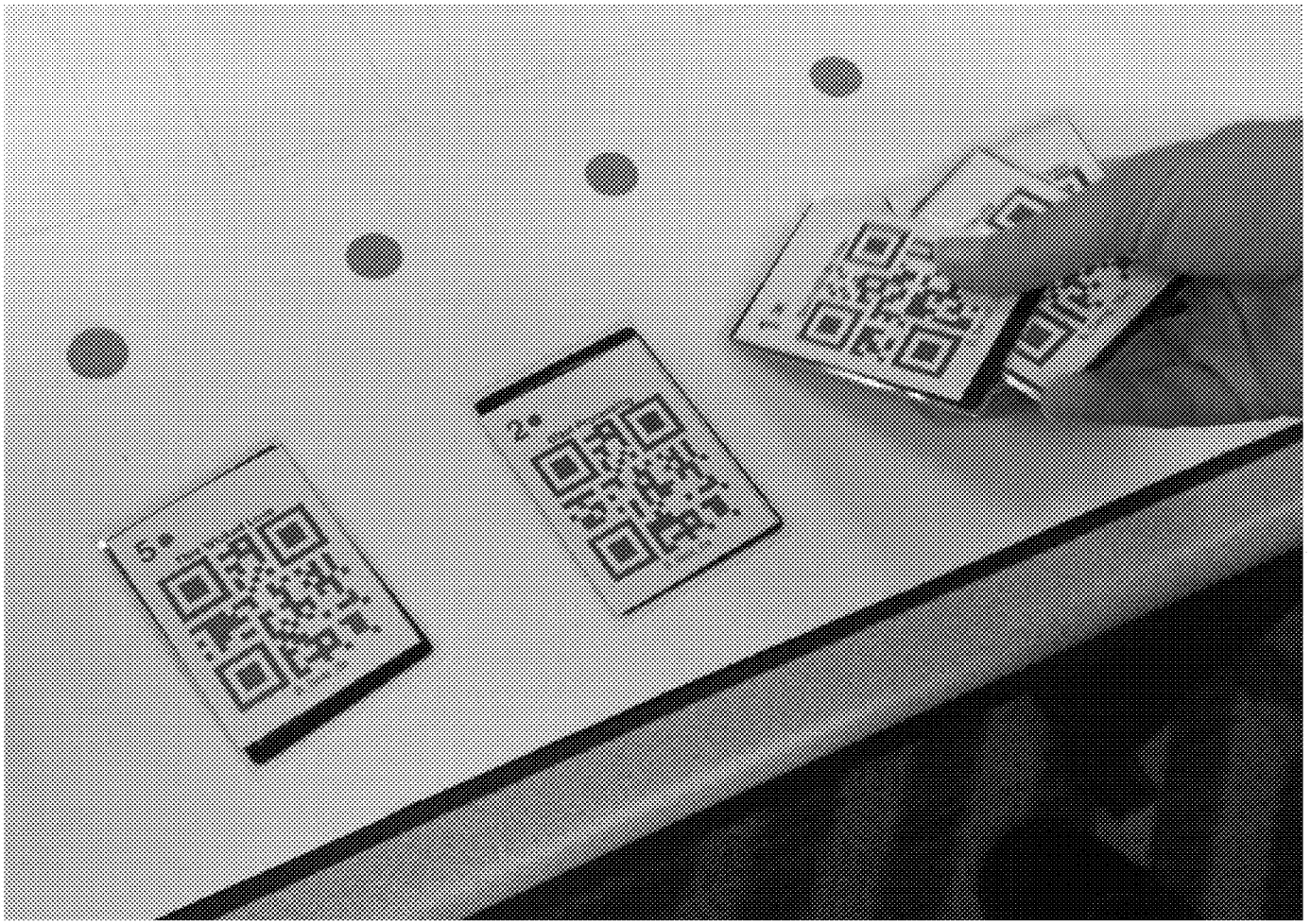
FIG. 3A-3F show different types of cards in accordance with some embodiments.

FIG. 3A shows different types of cards in accordance with some embodiments. For this exemplary embodiment, the cards include a two-dimensional barcode so that a visual sensor system can detect which card is played in a particular slot.

Figure 3B:
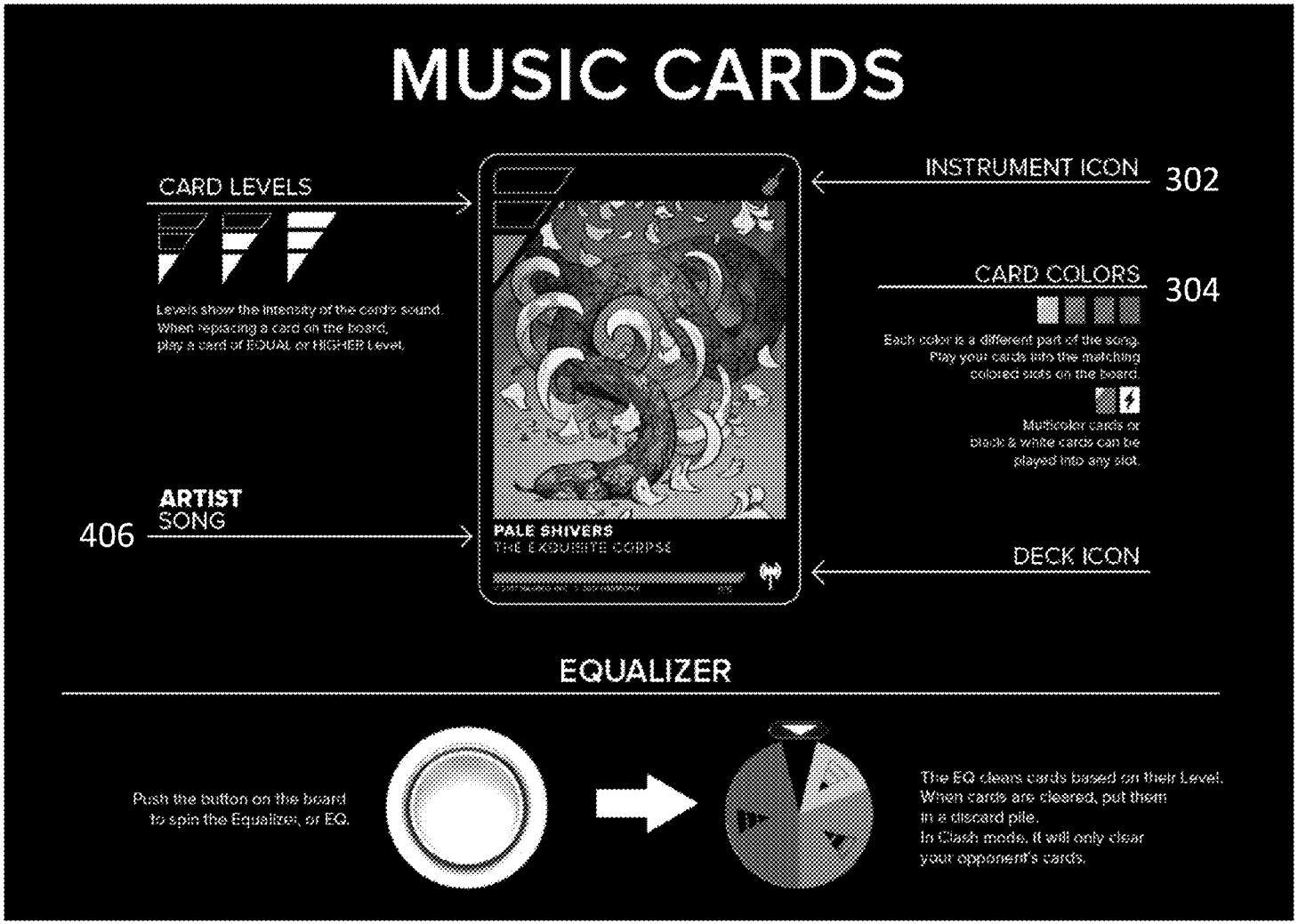

FIG. 3B shows a layout of a card that is associated with music in accordance with some embodiments. A card associated with music (also referred to as a music card or a music object) can cause the music synthesis module 118 to play a predetermined audio sample. For example, when a music object is deployed on a matching slot on the music mix layout, the music synthesis module 118 to play a predetermined audio sample, such as an audio sample of a particular instrument, a particular genre, and/or a particular artist. When a music object is associated with a particular instrument, the music object can include an instrument icon 402 indicating that particular instrument; when a music object is associated with a particular artist, the music object can include an artist icon 402 indicating that particular artist.

Figure 3C:
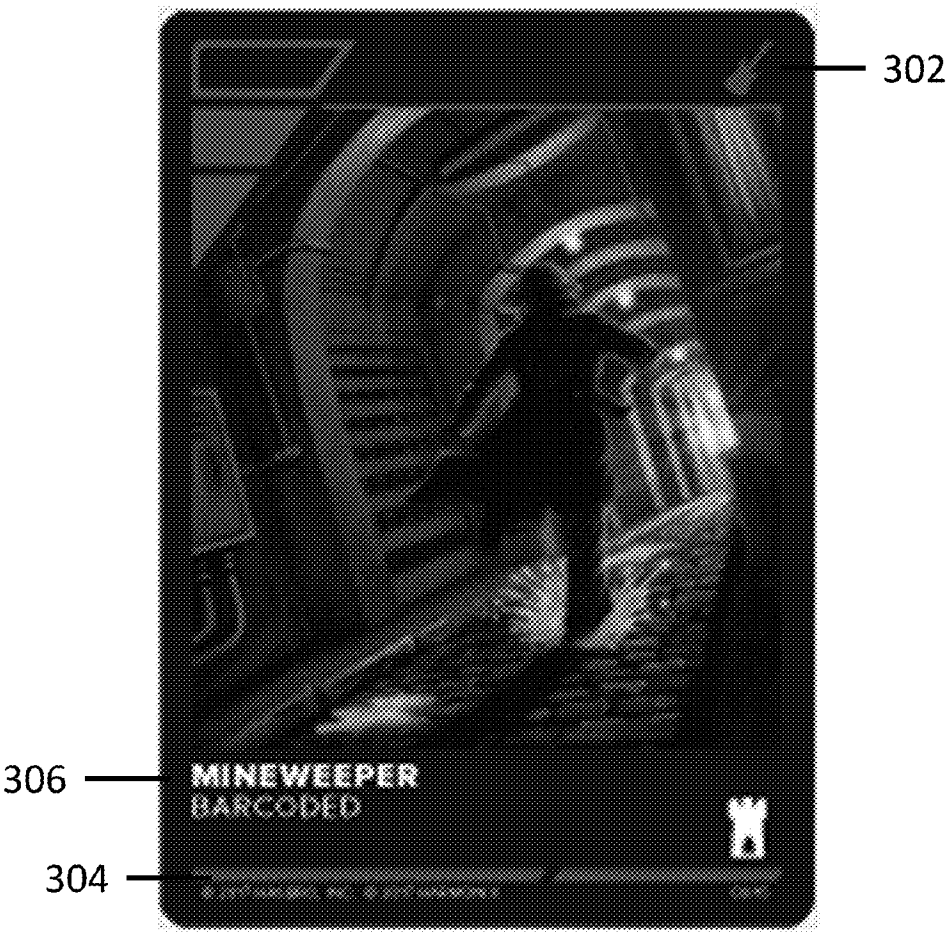

In some embodiments, each music object can be associated with a particular color 404. Each color can represent a particular musical attribute. For example, a green music card represents bass parts of the musical composition and other harmonic content; a blue music card represents the beats that define the rhythm of the musical composition; a red music card represents the loops that establish the melodic foundation of the musical composition; and a yellow music card represents the melodic lead content, typically vocals. One example of a music card is illustrated in FIG. 3C in accordance with some embodiments.

Figure 3D:
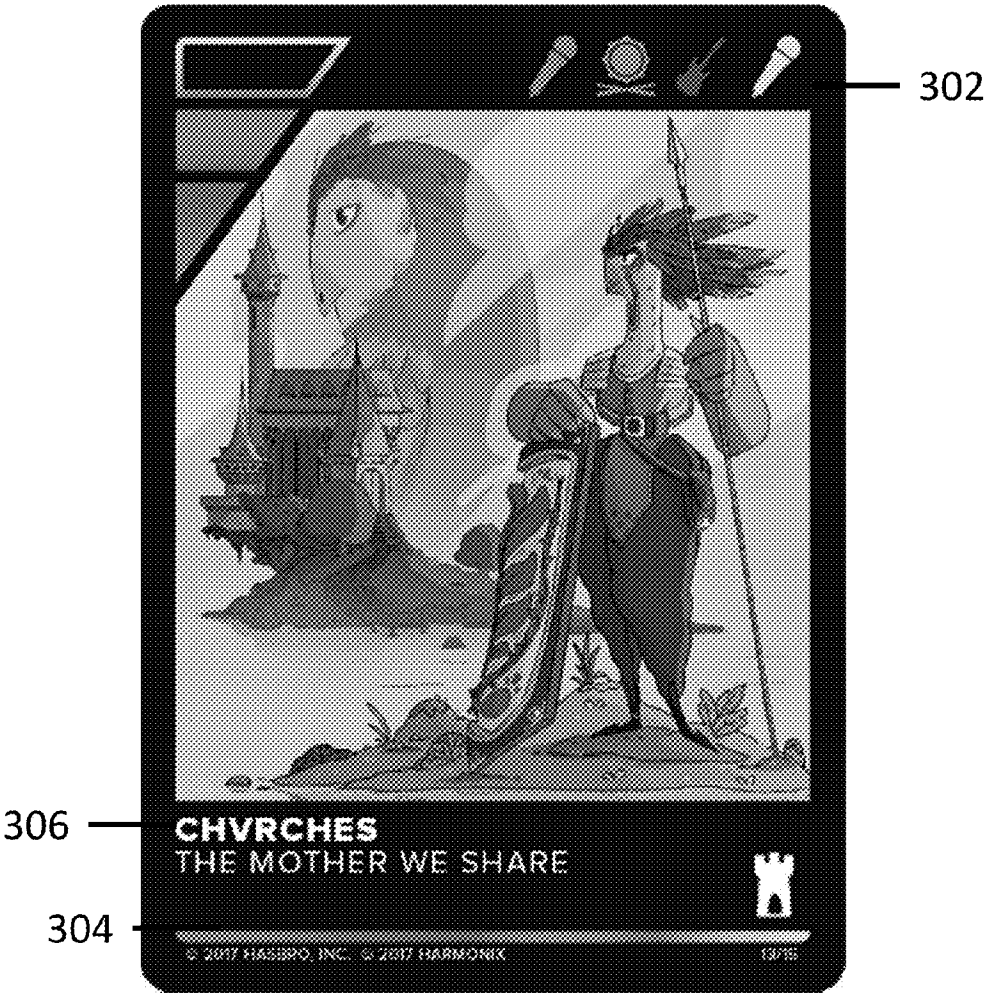

FIG. 3D shows a layout of a card that is associated with a wild object type in accordance with some embodiments. In some cases, a card (or, more generally, an object) can be a wild object type. A wild object can be placed into any slot in the music mix layout, and can cause the music synthesis module 118 to play different audio samples based on the slot to which the object is deployed. In some embodiments, a wild object can be associated with a plurality of colors 304, indicating the slots on which the wild object can be deployed. In some embodiments, a wild object can be associated with a plurality of instruments, as indicated by the instrument icons 302. Each instrument can be associated with a particular color, indicating the type of instrument that would be played when the wild object is deployed in the slot associated with the particular color.

Figure 3E:
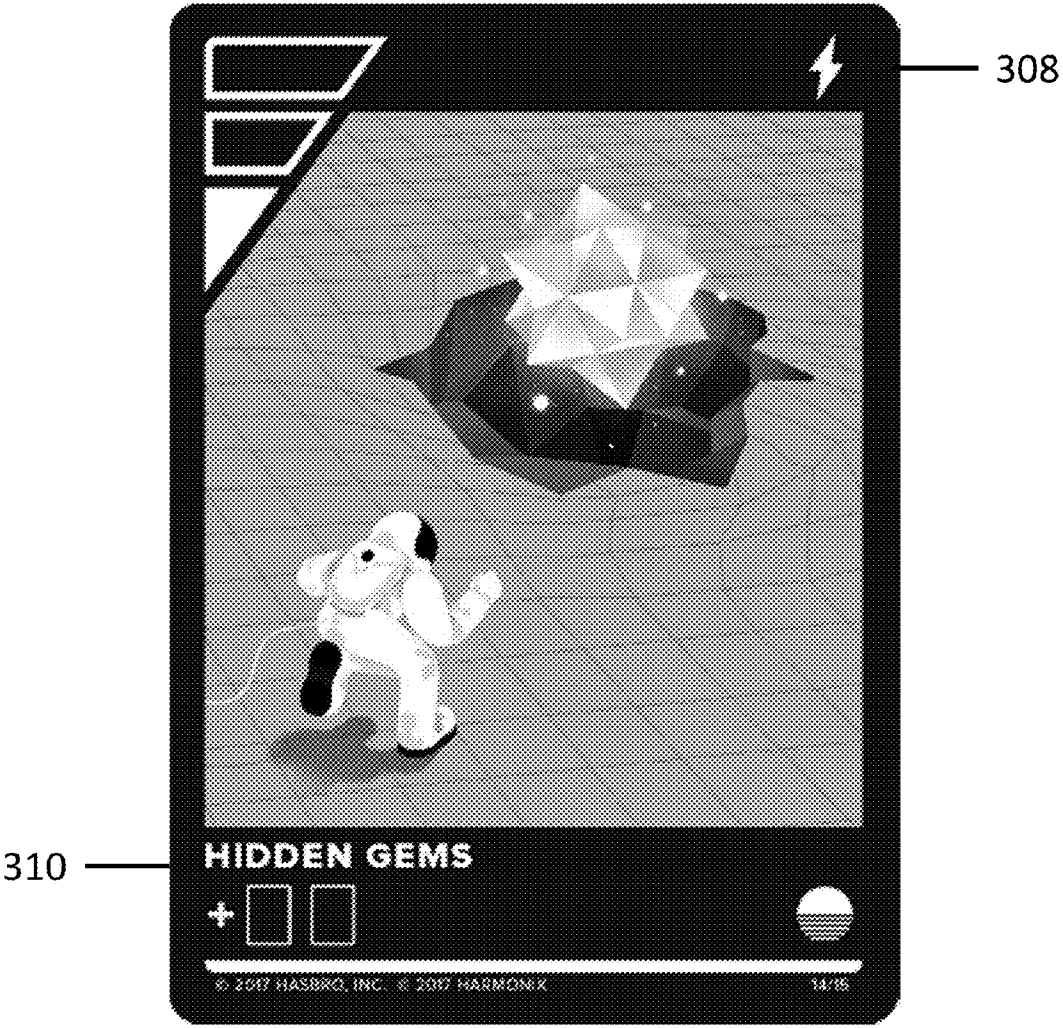

FIG. 3E shows a layout of a card that is associated with a special event in accordance with some embodiments. A card associated with a special event, also referred to as a special card (or more generally, a special object) can cause the music synthesis module 118 to trigger a special event. A special event can include, for example, scoring bonus points or allowing a player to draw one or more extra cards. A special object can be deployed in any slot in the music mix layout. Each special object has an audio loop that is heard no matter where the object is deployed. In some embodiment, a special object is identified by a special object symbol 308, and can show a description 310 of the special event associated with the special object.

Figure 3F:
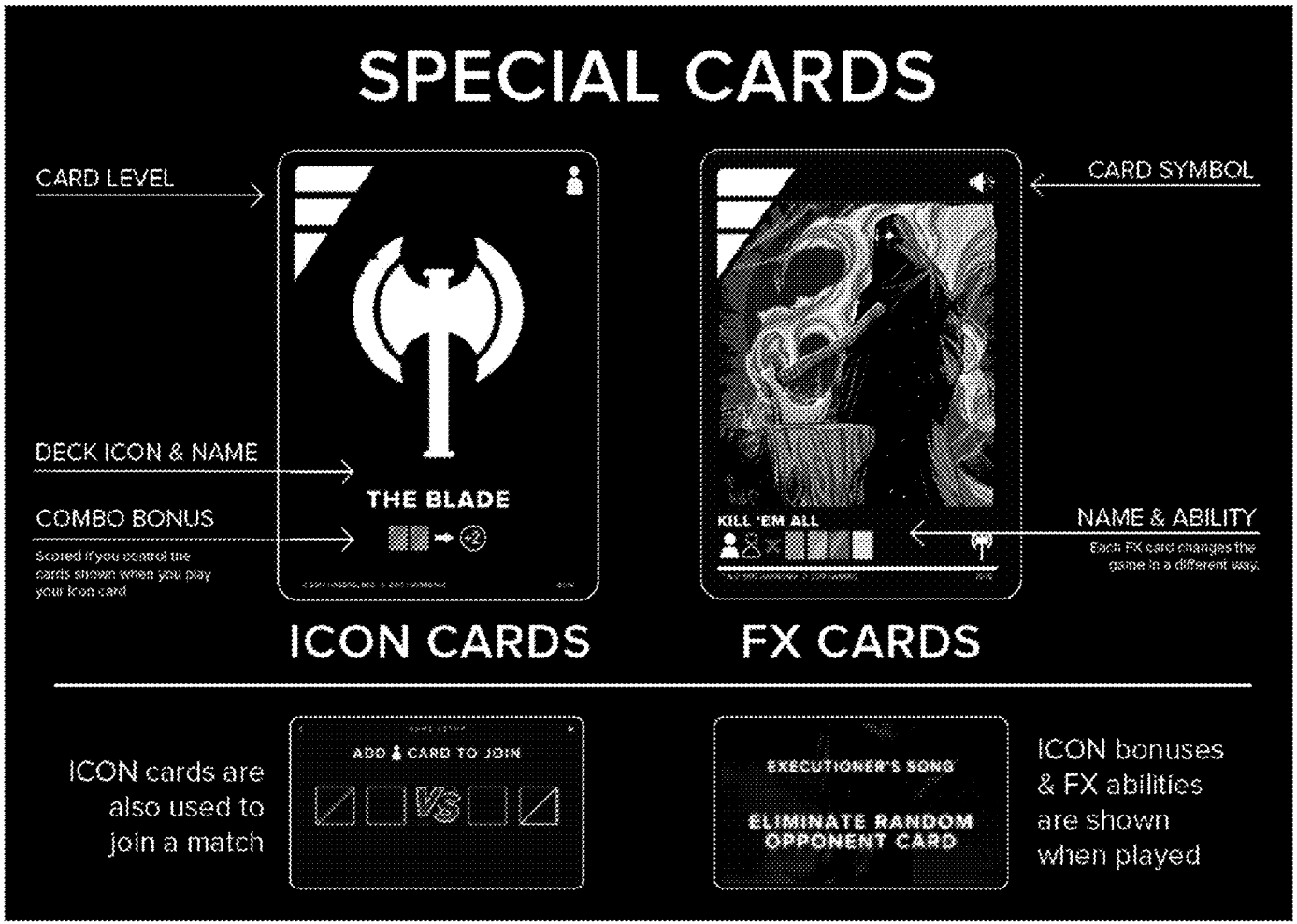

FIG. 3F shows a layout of a card that is associated with an icon in accordance with some embodiments. In some embodiments, a special card, such as an "icon" card, can be an identifier of a group card, in addition to being an object with special abilities. For example, an icon card can be an identifier of a deck or a user, such as a player persona or profile.

The following disclosure describes embodiments in which the containers or objects are cards. However, other embodiments are also contemplated, as described herein. The objects can include, for instance, a toy that is indicative of musical contents and/or attributes. For example, the object can be a dog stuffed animal indicative of a dog's growling sound. The objects can include, for instance, representative figures of one or more types. For example, the objects can be action figures, war game-style miniatures, and/or dolls. The objects can include, for instance, blocks that can be snapped together, and/or pieces that can be magnetically joined. These blocks can enable players to physically pre-configure the musical contents associated with the blocks before adding the musical contents to the musical composition. The object can also be, for instance, a physical article that can indicate several states based on the orientation and/or position (e.g., dice). Such a physical article can enable players to dynamically alter or randomize the musical content while the physical article is in the music mix layout. The object can also be, for instance, any physical representation (e.g., figurines or chips) and/or any digital representation (e.g., icons or records).

In some embodiments, a music synthesis module 118 models a musical composition as a combination of one or more musical contents and musical attributes. A player of the platform can control the musical contents and/or musical attributes using one or more cards. A card is a representation, to the player and the music synthesis module 118, of a type of musical impact the card will have when played by the music synthesis module 118. The representation does not require knowledge of music theory. Therefore, the cards can convey the result of playing the card without requiring knowledge of music theory. For example, a card can include a picture of rain to indicate to the player that the music synthesis module 118 would slow down the music or soften the tempo, or that the music synthesis module 118 would play the sound of falling rain. As another example, a card can include a picture of a well-known or popular music artist so that when the card is played, the music synthesis module 118 adds that artist's voice in the musical composition or modifies the attributes of the musical composition based on that artist's music.

In some embodiments, a card can be associated with a musical container. A musical container can include (1) musical content and/or (2) the musical attributes of the musical content and/or the musical composition. When a player deploys a card (e.g., onto a physical or virtual mix layout), the music synthesis module 118 can use the associated musical content and/or transform the musical attributes of the musical composition.

In some embodiments, musical content can represent a musical sample. A typical musical sample is, for example, 1 to 32 bars in length. A musical sample can be (a) a bassline sample, (b) a drum sample, (c) a vocal sample, (d) a guitar sample, (e) a violin sample, and/or a variety of musical samples associated with different instruments. Musical content can be associated with a content type. For example, when the content type is a "loop," the music synthesis module 118 can play the musical content in a loop (e.g., replay from the beginning when the end of the musical content is reached). The loop can be time-synchronized with the underlying musical composition. When the duration of the loop is longer than usual, the "loop" content type can also be referred to as a "continuous linear play" content type. As another example, when the content type is a "one-off sound effect," the music synthesis module 118 can play the musical content only once. As another example, when the content type is a "continuous linear play," the music synthesis module 118 can play the musical content continuously, such as playing musical content with a time that exceeds the expected duration of play (e.g., a ten-minute track).

In some embodiments, a card can be associated with musical attributes, providing the card with an ability to transform the musical attributes of the card's musical content and/or the musical composition being generated by the platform. For example, the card can cause the music synthesis module 118 to transform the harmony of the musical composition (e.g., inverting from a major chord to a minor chord, or vice versus). As another example, the card can cause the music synthesis module 118 to modify the key of the musical composition. As another example, the card can cause the music synthesis module 118 to adopt a chord progression for the musical composition. As another example, the card can cause the music synthesis module 118 to change the instrument associated with a particular musical sample in the musical composition.

In some embodiments, the musical attributes can include the following:

- type of the musical content (e.g., "beat" type, "bassline" type, "melody" or "sample" type, "exclusive sample" type)
- genre of the musical content
- meter, indicating a number of beats that make up a bar (e.g., a measure of music);
- tempo, indicating an amount of time (e.g., speed) at which a beat passes by, often measured in a beats-per-minute (BPM);
- rhythm, indicating the time at which each note plays in relation to the meter and tempo
- pitch, indicating the pitch of each note in the musical content;
- harmony, indicating the chord(s) and chord-scale relationship(s) underlying the musical content associated with the card, which is also capable of indicating, for example, the key (e.g., C, C#, D), the mode (e.g., major, minor), and chord progression (e.g., C, Am, Dm7, G7), whether explicit in the musical content or implied by the musical content;
- feel, indicating whether the rhythm is straight rhythm, with even $8^{th}$ or $16^{th}$ notes, or a swung/shuffled, with uneven $8^{th}$ or $16^{th}$ notes; and/or
- form, indicating how the musical content fits into the game's global timeline and/or the time offset of the musical content in relation to larger phrase lengths or in relation to a global song form (e.g., verse, chorus, bridge).

In some embodiments, a card can be associated with a plurality of musical contents. In such embodiments, different musical contents can be played depending on parts of a phrase or sections of a song form.

In some embodiments, a card may not be associated with any musical content, but can still be associated with musical attributes (e.g., tempo, harmony, feel, form, and/or the like). In this case, the attributes can be used to alter the attributes of other cards in the music mix layout, causing the musical contents of other cards to playback differently.

In some embodiments, a card may not be associated with any musical contents or musical attributes, but instead can be associated with digital signal processing (DSP) effect parameters that affect the sound of one or more cards. Such DSP effects can include reverberation, delay (echo), flanging, chorusing, distortion, bit crushing, EQ (equalization/filtering), and others. Therefore, a card can cause the music synthesis module 118 to add digital sound effect to the musical composition.

In some embodiments, a card can be of an exclusive type. When a card is associated with an exclusive type, the music synthesis module 118 can allow only a predetermined number of cards of that type in the mix layout 200. For example, the music synthesis module 118 can allow one card associated with bassline in the music mix layout 200, whereas the music synthesis module 118 can allow two cards associated with beats in the music mix layout 200.

In some embodiments, an exclusive card can be associated with a certain tempo, key, and/or other musical properties. By requiring the music mix layout 200 to use only a single exclusive card at a time, the music synthesis module 118 can ensure that the musical content in the exclusive card is played at its original tempo and key, thereby shifting or modifying the rest of the musical composition to match the tempo and key of the exclusive card. This allows for melodic content, such as sung vocals, to be played back without distortions such as pitch shifting. This feature helps a player to recognize the musical content of the exclusive card.

In some embodiments, a card can be a dominant card that is capable of modifying musical contents of other cards in accordance with characteristics of the dominant card (e.g., tempo and beat). The notion of a master card is desirable because some cards, such as those associated with an artist, should have exclusivity to ensure that desired characteristics are preserved (e.g., the voice of an artist, the style of an artist, and/or the like). For example, when a master card is associated with a chord progression, then this card can modify the musical contents of other deployed cards to match the chord progression specified in the master card.

In some embodiments, a card can be a slave card that merely follows characteristics of existing cards in the music mix layout. For example, a slave card can specify a bassline that is transformed by the harmonic transform already in play.

In some embodiments, a card can have a partial dominance. In this case, the card may have the ability to modify attributes of only one or more cards in the music mix layout, rather than all the cards in the music mix layout.

In some embodiments, when the music synthesis module 118 provides a gameplay to a plurality of players, the cards can also have indications useful for gameplay rules. For example, a card can be associated with a "power" or a "level," indicating whether a particular card can mute or eject the sound of another card that had previously been deployed by another player (e.g., in the same slot and/or in a different slot).

Figure 9:
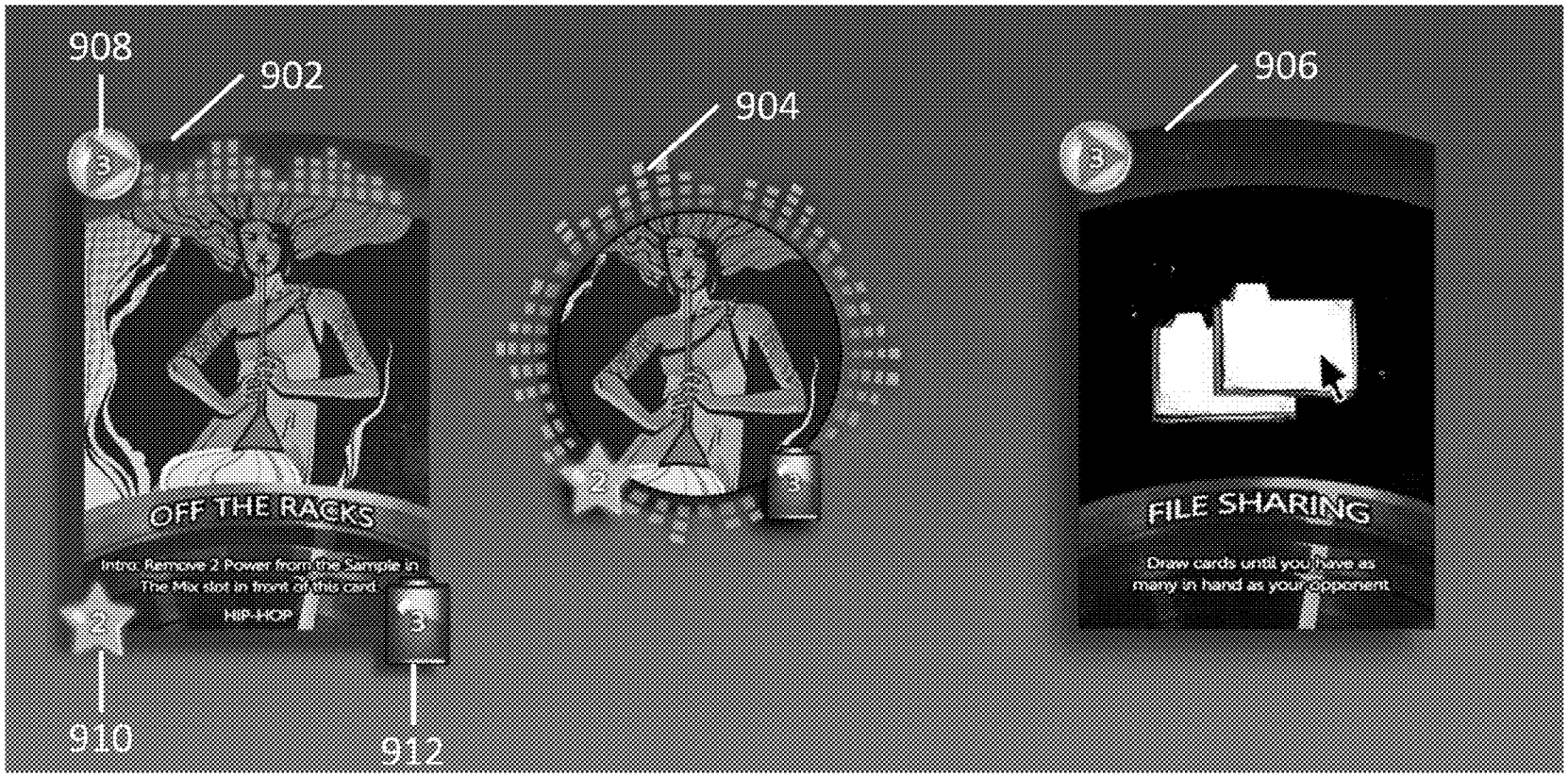
FIG. 9 shows images of cards and an in-game representation of a card in accordance with some embodiments.

FIG. 9 shows images of cards and an in-game representation of a card in accordance with some embodiments. The first card 902 is associated with a musical content type (e.g., a musical sample type), as indicated by its color and visual design elements. A card of a musical content type can include an "Action Points" value 908, indicated by a Play Button icon. The "Action Points" value can represent resources that a player needs to spend in order to put the card into play (e.g., place the card into the queue (as described below) and/or onto the music mix layout 200. A musical content type card can include a "Crowd Points" value 910 in the lower left, indicated by a star-shaped icon. The "Crowd Points" value 910 can represent the score value of having the card in the mix. A musical content type card can also include a "Power" value 912 in the lower right, indicated by a battery-shaped icon. The "Power" value 912 can represent the strength of the card when competing to enter the mix layout 200. The card can also include descriptive text about its particular gameplay and music attributes/properties. Once the first card 902 is placed into the music mix layout 200, the first card 902 can be represented using an in-game icon 904 on the music mix layout 200.

The second card 906 is associated with an effect type, as indicated by its color and visual design elements. Rather than representing musical content, an effect card can represent a "modifier" that changes the game state and/or audio state. For example, the second card 906 can cause the game platform to share the files in accordance with properties of the second card 906.

Figure 10:
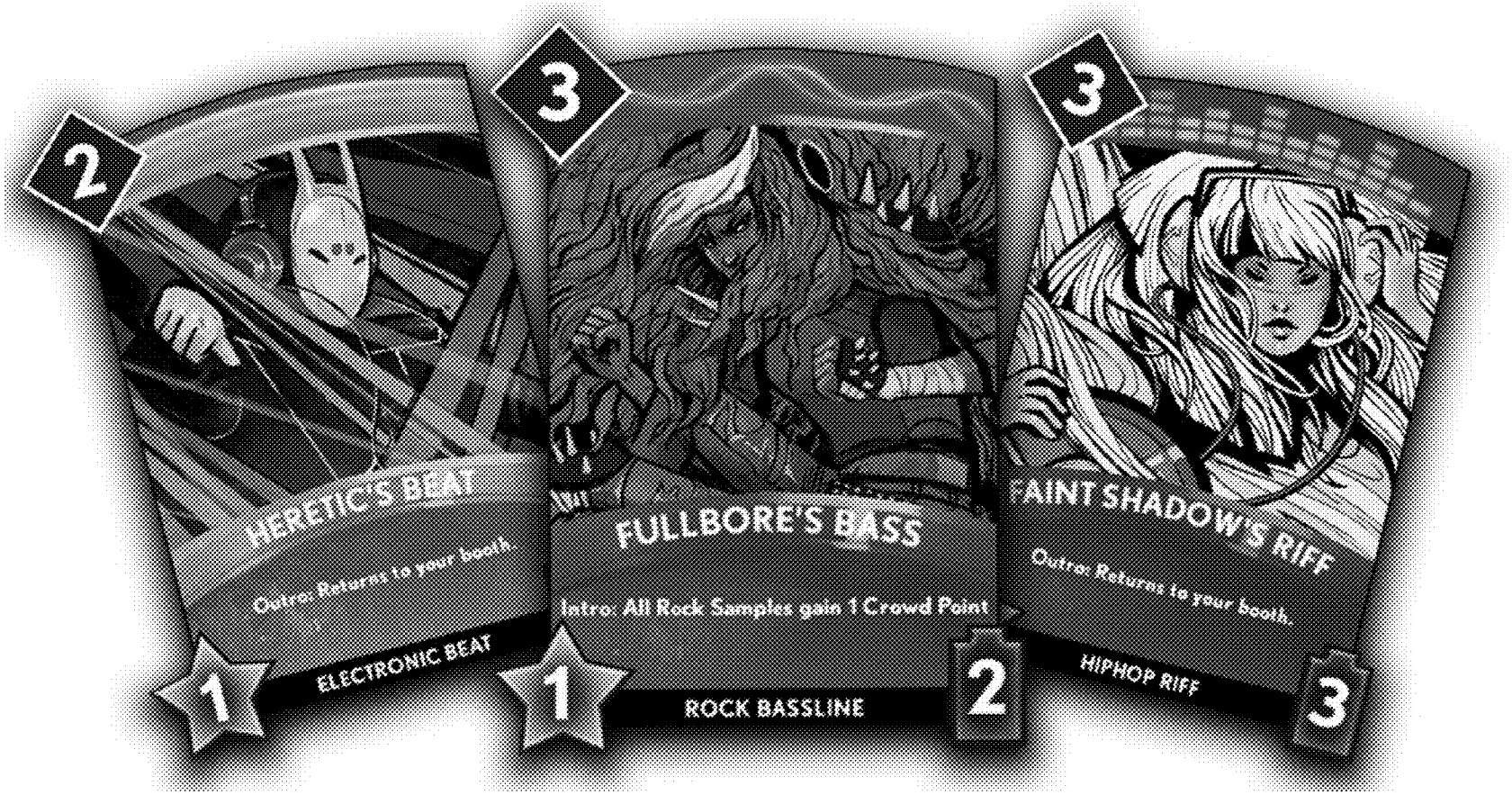
FIG. 10 shows additional examples of card designs, showing variations in the visual style and text description in accordance with some embodiments.

FIG. 10 shows additional examples of card designs, showing variations in the visual style and text description in accordance with some embodiments.

In some embodiments, the music synthesis module 118 can provide a preview feature. In some cases, a player of the platform may want to hear the musical effect of a card prior to using the card. To this end, the music synthesis module 118 may enable a player to preview the effect of using a card without actually fully committing to the card. For example, the music mix layout 200 can include a preview slot that allows a player to preview an effect of a card. As another example, the music synthesis module 118 can include a partial play feature that allows a user to preview an effect of a card. In a gameplay setting with multiple players, the opponents may not be aware that a player is previewing an effect of a card. For example, each player may wear separate headphones, and the preview may be provided only to the headphone associated with the player previewing the card. As another example, there may be a global sound system shared by all players, but the preview may be provided only to the headphone associated with the player previewing the card.

Figure 4:
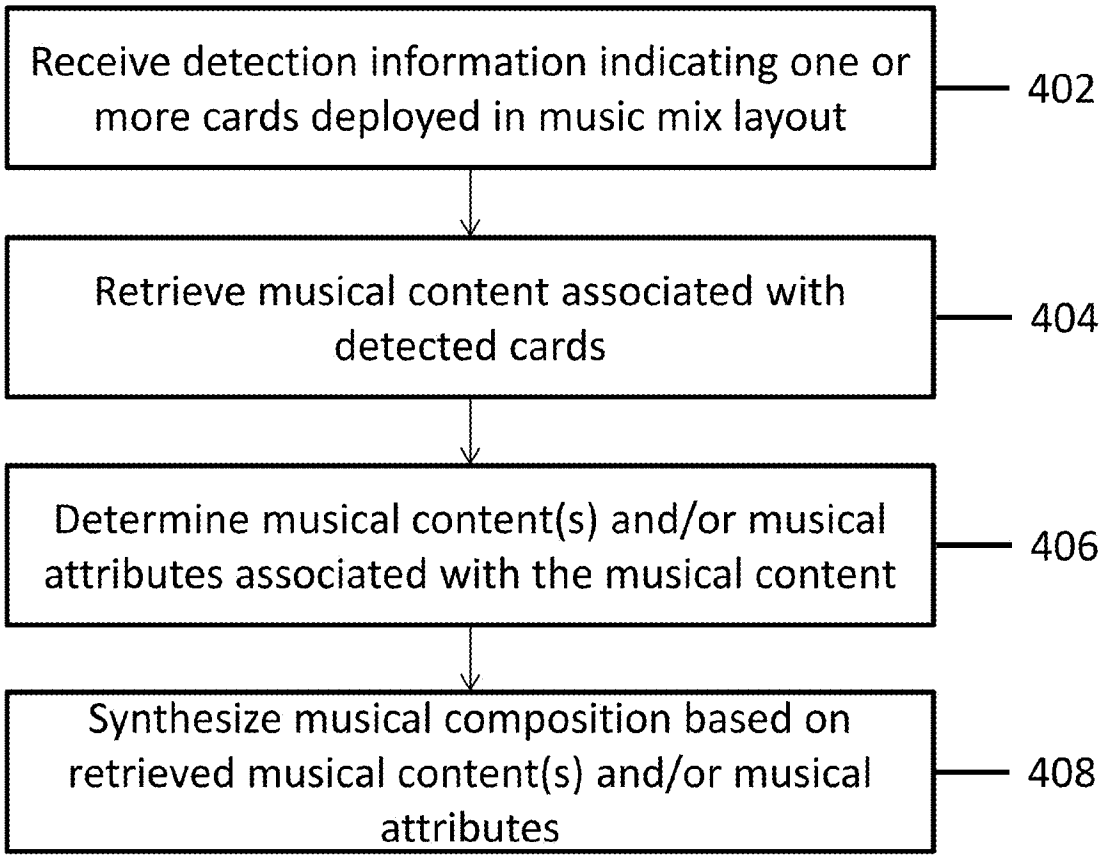
FIG. 4 illustrates an operation of a musical synthesis module for generating a musical composition in accordance with some embodiments.

The musical synthesis module 118 in the platform 100 can be used to create a musical composition. FIG. 4 illustrates an operation of a musical synthesis module for generating a musical composition in accordance with some embodiments. In step 402, the platform can detect one or more cards placed on the music mix layout 200 and provide the detection information (e.g., also referred to as container selection information) to the musical synthesis module 118, indicating one or more cards deployed in the music mix layout 200. In step 404, the musical synthesis module 118 can retrieve musical content (or a container) associated with the detected card(s) from the memory device 104. In step 406, the musical synthesis module 118 determines the musical content(s) and/or musical attributes associated with the retrieved musical container(s), and in step 408, the music synthesis module 118 can create a musical composition in accordance with the musical contents and the attributes associated with the detected cards.

In some embodiments, the musical synthesis module 118 can create the musical composition interactively with the player. For example, when the player places a card on the music mix layout 200, the musical synthesis module 118 update the music to reflect the newly-paced card on the music mix layout 200. In other words, the music synthesis module 118 is configured to update the musical composition in real time in order to keep the musical composition up-to-date with the cards deployed on the music mix layout 200.

In some embodiments, the musical synthesis module 118 can determine global attributes for the target musical composition. The global attributes can include, for example, the tempo, harmony, form and feel, as described previously. Generally, the musical synthesis module 118 applies the global tempo to musical contents of all cards in play in order to play the musical contents in sync and in harmony with each other. If and when the attributes change during gameplay, the musical synthesis module 118 modifies the musical contents of all cards to follow the new attributes or be silenced or removed from the musical composition.

In some embodiments, the initial set of musical attributes associated with the musical composition is determined by the first card(s) placed on the music mix layout 200. In other words, the first card(s)'s attributes become the initial global attributes for the musical composition. When the musical synthesis module 118 detects an additional card subsequent to the first card(s), the musical synthesis module 118 can either conform the attributes of the subsequent card to the global attributes, or in special cases, replace the global attributes with the attributes of the subsequent card.

For example, suppose that a player places a drum beat card associated with a tempo attribute of 90 BPM. In this case, the musical synthesis module 118 can set the global tempo to 90 BPM and play the musical content of the drum beat card at that tempo. Note that this card is not associated with any pitch or harmonic attributes. Therefore, the pitch and harmonic attributes are not yet globally set.

Subsequently, the player can place a piano melody card associated with a tempo of 110 BPM and the harmonic content of C major. Thus, the musical synthesis module 118 can set the global harmony to C major, but keep the tempo at 90 BPM since the global tempo was previously set by the drum beat card. Therefore, the musical synthesis module 118 can play the musical content at 90 BPM in sync with and simultaneously with the already playing drum beat card.

Suppose, now, that the player places a bassline card in E-minor having a tempo of 140 BPM. Since the global tempo and the global harmony have already been set by the previous cards, this bassline card conforms to the previously-determined global tempo and harmony, and plays along with the other cards in C major at 90 BPM.

If the player subsequently places a dominant card, such as a vocal sample card, in G minor having a tempo of 122 BPM, the musical synthesis module 118 can modify the global attributes in accordance with this dominant card. Therefore, in this case, the musical synthesis module 118 can play all four cards in sync in G minor at 122 BPM. This process is iterated to create a musical composition.

In some embodiments, the musical synthesis module 118 can modify the following musical attributes of the musical composition based on the deployed cards.

(1) Tempo—The musical synthesis module 118 can alter the tempo of musical contents associated with cards based on musical attributes of another card. These changes usually happen at a phrase boundary so that the musical composition sounds musical. In some embodiments, the musical synthesis module 118 may be required to keep the tempo within a predetermined range. For example, the musical synthesis module 118 may permit only the tempo within the range of 80 BPM and 180 BPM.

In some embodiments, the musical synthesis module 118 may modify the tempo of the musical composition by setting it to a predetermined absolute value. For example, a card may indicate that the global tempo of the musical composition should be set to 150 BPM. In other embodiments, the musical synthesis module 118 may modify the tempo of the musical composition by increasing (or decreasing) it by a predetermined percentage. For example, a card may indicate that the global tempo of the musical composition should be increased by 20% of the current tempo, or be decreased by 20% of the current tempo.

In other embodiments, the musical synthesis module 118 may modify the tempo of the musical composition over a predetermined period of time or a predetermined number of bars. For example, the musical synthesis module 118 may modify the tempo of the musical composition by increasing the tempo by 50% of the current tempo linearly over four bars. As another example, the musical synthesis module 118 may modify the tempo of the musical composition by changing the current tempo to 150 BPM linearly over eight bars.

(2) Harmony—The musical synthesis module 118 can alter the harmonic structure of musical contents associated with cards based on the harmonic attribute of another card. These changes usually happen at a phrase boundary so that the musical composition sounds musical. In some embodiments, the musical synthesis module 118 can limit the number of allowable keys, modes, and chords. In other embodiments, the musical synthesis module 118 may not limit the number of allowable keys, modes, and chords.

In some embodiments, the musical synthesis module 118 may modify the harmonic structure of a musical composition by setting it to a predetermined absolute harmony. For example, the musical synthesis module 118 may change the current harmony of the musical composition to an Eb minor. To do so, the musical synthesis module 118 can transpose or alter all notes in all musical contents of the deployed cards to a scale appropriate for Eb minor.

In other embodiments, the musical synthesis module 118 may modify the harmonic structure of a musical composition by transposing the harmonic structure up or down by a predetermined number of intervals. For example, the musical synthesis module 118 may modify the harmonic structure of a musical composition by transposing the harmonic structure up by a $4^{th}$. In this case, the musical synthesis module 118 would modify the harmonic structure of a musical composition in C major to F major.

In other embodiments, the musical synthesis module 118 may modify the harmonic structure of a musical composition by changing the mode of the harmonic structure. For example, the musical synthesis module 118 may change the mode of a musical composition from major to minor, or vice versa. In this case, the musical synthesis module 118 would modify the harmonic structure of a musical composition in C major to C minor.

In other embodiments, the musical synthesis module 118 may modify the harmonic structure of a musical composition by modifying the current mode to its relative minor or a relative major. For example, the musical synthesis module 118 may modify the harmonic structure of a musical composition in C major to A minor, or vice versa.

In other embodiments, the musical synthesis module 118 may modify the harmonic structure of a musical composition by imposing a chord progression (absolute or relative) on the current harmony or the current chord progression. For example, the musical synthesis module 118 can alter a musical composition in C to follow a cord progression of I, vi, ii7, V7 (C, Am, Dm7, G7). In some cases, the chord progression may have a built in harmonic rhythm that determines the duration of each chord. For example, each chord can last for two beats or four beats. As another example, the first two chords can last for four beats, the third chord can last for six beats, and the fourth chord can last for two beats.

(3) Feel—The musical synthesis module 118 can alter the feel of musical contents associated with cards based on the feel attribute of another card. In some embodiments, the musical synthesis module 118 can alter the feel by altering the notes from straight notes to swung notes, or vice versa. For example, the musical synthesis module 118 can alter the rhythm of notes in the musical contents from evenly spaced $8^{th}$ notes to swung $8^{th}$ notes where any notes normally appearing at tick 240 (assuming 480 ticks per quarter note), are delayed, say to tick 320, to produce a swing rhythm.

In other embodiments, the musical synthesis module 118 can alter the feel by modifying the playback rate of musical contents of one or more cards while maintaining the playback rate of musical contents of other cards. For example, the musical synthesis module 118 can reduce the playback rate of the drum beat card(s) by 50% to create a half-time feel. In this case, the tempo of the music remains the same, but the drum beats play back half as fast.

(4) Form—The musical synthesis module 118 can establish the global form of a musical composition based, in part, on attributes of a card and/or parameters associated with a gameplay. For example, the musical synthesis module 118 can establish a common eight-bar phrase length. The musical synthesis module 118 can also establish song sections, such as a verse, chorus, and/or a breakdown.

In some embodiments, the musical synthesis module 118 can fix the form of a musical composition at initiation. For example, the musical synthesis module 118 can set the form of a musical composition as "intro, verse, chorus, verse, chorus, bridge, chorus, chorus, outro," and the musical synthesis module 118 can modify the musical content and/or attributes of a deployed card depending on the location of the section for which the card is deployed.

In some embodiments, the musical synthesis module 118 can update the form of the musical composition based on an attribute of a card. For example, the musical synthesis module 118 can jump to a "chorus" of the musical composition when a particular card forces a jump to the "chorus". In some embodiments, the musical synthesis module 118 can update the form of the musical composition based on the progress of a gameplay. For example, the musical synthesis module 118 can alter the form of a musical composition when a score of the player reaches a predetermined threshold.

In some embodiments, the musical synthesis module 118 can save and retrieve song sections for later use. For example, one card may cause the musical synthesis module 118 to save the currently playing cards and label them a bridge. At a later point in time, another card may cause the musical synthesis module 118 to retrieve the bridge, thereby retrieving and deploying all the cards associated with the bridge.

In some embodiments, the musical content of one or more cards may or may not have unique content depending on the form of a musical composition. For example, a drum beat card may play a specific beat for the first seven bars of an eight bar phrase, then during the $8^{th}$ bar, play one of a number of fills (e.g., variations) that temporarily breaks away from the established musical pattern.

In some embodiments, one or more cards may carry alternate musical contents for different parts of a song form. For example, when the musical synthesis module 118 plays a drum beat card, the musical synthesis module 118 can play a beat using the kick, snare, and hi-hat during a "verse," but play the kick, snare, and ride cymbal during a "chorus." In some cases, the musical synthesis module 118 can play the musical sample in mono during verse, but play the musical sample in stereo during "chorus" to provide more volume.

Because the musical synthesis module 118 may modify the musical content and/or attributes of a card based on the form in which the card is deployed, changing the form of a musical composition may alter the way the musical synthesis module 118 plays the card. In some embodiments, when a card is associated with two or more musical contents tied to particular sections of a form, the musical synthesis module 118 may adapt the musical content based on the section in which the card is deployed. For example, if a card has a special musical content associated with "chorus," the musical synthesis module 118 can play that special musical content during the "chorus."

In some embodiments, the musical synthesis module 118 can impose certain musical attributes on a card based on the section in which the card is deployed. For example, the musical synthesis module 118 can transpose the harmony of a card by a predetermined number of notes and/or change the tempo of the musical content when the card is deployed in the "chorus" section.

In some embodiments, the musical synthesis module 118 can alter the playback behavior of musical contents when they are played in particular song sections. For example, the musical synthesis module 118 can silence all cards that are not drum beat cards or bassline cards. As another example, when a drop card is deployed, the musical synthesis module 118 can play an electronic dance music-style buildup during the last four bars of an eight bar phrase, ending with a release (a Drop) into the next section of the form.

(5) DSP effects—The musical synthesis module 118 can apply certain DSP audio effects to musical contents associated with cards based on the harmonic attribute of another card, sometimes referred to as an "effect" card. In some cases, the effect card may cause the musical synthesis module 118 to apply the DSP effects only to musical contents of certain targeted cards. In some embodiments, the musical synthesis module 118 may apply the DSP effects for a predetermined period of time, or until the target cards are removed from the music mix layout 200. In some embodiments, the DSP effects can include reverberation, delay (echo), flanging, chorusing, distortion, bit crushing, EQ (equalization/filtering), and others.

(6) Sample content—The musical synthesis module 118 can alter specific note(s) or sample content(s) in targeted cards based on attributes of another card. For example, a first card can interfere with a second card by causing the musical synthesis module 118 to play the musical contents of the second card in a reverse or random order. As another example, a first card can cause the musical synthesis module 118 to play the musical contents of a second card at a different octave (e.g., by changing the root pitch associated with the second card), causing the musical synthesis module 118 to play the second card an octave too high or an octave too low. As another example, a first card can cause the musical synthesis module 118 to skip one or more notes of a second card. For instance, the first card can cause the musical synthesis module 118 to play every other note from the second card. As another example, a first card can cause the musical synthesis module 118 to adjust the envelope (Attack, Decay, Sustain, Release, or ADSR) of musical contents of a second card. This causes the musical contents of the second card to fade in and/or out.

Figure 5:
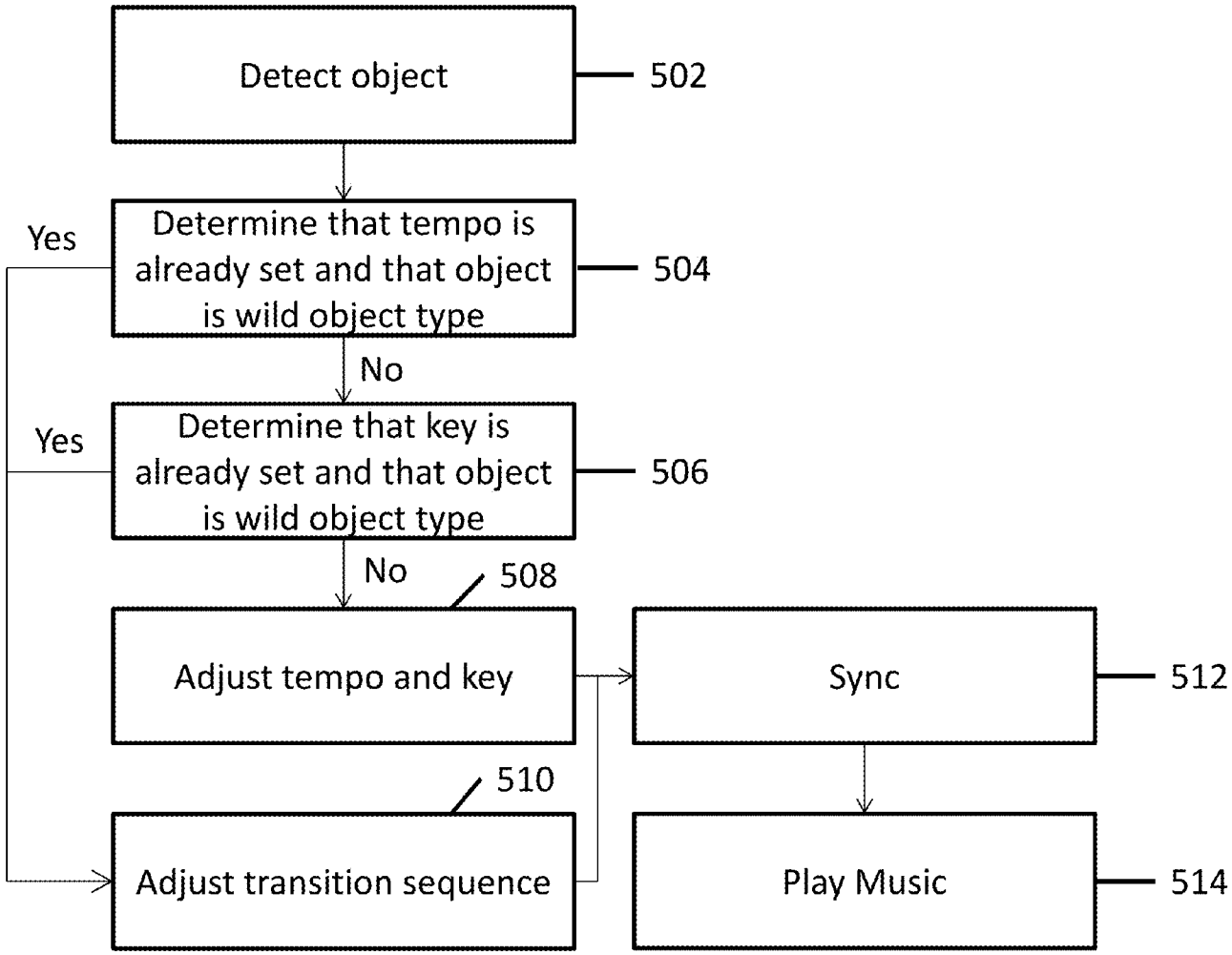
FIG. 5 illustrates a process for generating a musical composition in accordance with some embodiments.

FIG. 5 illustrates a process for generating a musical composition in accordance with some embodiments.

In step 502, the musical synthesis module 118 can be configured to receive detection information indicating that one or more objects have been deployed in the music mix layout. Optionally, the musical synthesis module 118 is configured to determine whether the deployed object is valid based on a rule associated with the musical synthesis module 118. For example, the musical synthesis module 118 can determine whether the deployed object is placed on a slot that is compatible with the particular type of deployed object. When the deployed object is not compatible with the slot on which the object is deployed, the musical synthesis module 118 can provide an error notification on one or more audio/video devices 114.

In step 504, the musical synthesis module 118 can be configured to determine whether the game clock and the tempo of the musical composition has been set. The game clock refers to a musical timeline. The musical timeline can be described in the length of a phrase (e.g., the number of bars), bars, beats (subdivisions of bars), ticks (subdivisions of beats) and/or tempo (how fast the clock is, in #beats per minute).

In some embodiments, when the game clock and the tempo have not been set, the musical synthesis module 118 can initiate a game clock (e.g., a 32-bar loop) and set the game tempo as specified by the object. Then the musical synthesis module 118 can proceed to step 506.

In some embodiments, when the game clock and the tempo have been set, the musical synthesis module 118 can determine whether the object is a wild object type. A wild object type includes a type of object that can reset the tempo and key of the musical composition. When the object is a wild object type, the musical synthesis module 118 can proceed to step 510.

In step 506, the musical synthesis module 118 is configured to determine whether the key of the musical composition has been set.

In some embodiments, when the key of the musical composition has not been set, the musical synthesis module 118 can set the key as specified by the object. Then the musical synthesis module 118 can proceed to step 508.

In some embodiments, when the key of the musical composition has been set, the musical synthesis module 118 can determine whether the object is a wild object type. When the object is a wild object type, the musical synthesis module 118 can proceed to step 510; when the object is not a wild object type, the musical synthesis module 118 can proceed to step 508.

In step 508, the musical synthesis module 118 is configured to determine whether the object's tempo and key match the current tempo and key of the musical composition. When the object's tempo and key match the current tempo and key of the musical composition, the musical synthesis module 118 can proceed to step 512. When the object's tempo and key do not match the current tempo and key of the musical composition, then the musical synthesis module 118 can modify the current tempo and key of the musical composition to match the tempo and key of the deployed object.

In some embodiments, the musical synthesis module 118 can modify the current tempo, feel, key, and mode of the musical composition to match the tempo, feel, key, and mode of the deployed object by manipulating the melody samples (e.g. MIDI or prerecorded audio) that collectively form the musical composition. In some cases, this manipulation could take the form of pitch transposition, in whole or in part, to synchronize key and mode. For example, the musical synthesis module 118 can use a pitch-scaling technique to pitch the melody samples up or down without changing the duration. As another example, the musical synthesis module 118 can use a formant technique to pitch the melody samples up or down without changing tonal color (key manipulation), or swapping out different melody samples (mode manipulation). Such pitch transposition can be done using midi control message transposition, time-maintaining audio pitch changing signal processing, or other techniques.

In other cases, this manipulation could take the form of time transposing melody samples, in whole or in part, to synchronize tempo and feel. The time transposition may be accomplished by time-stretching or time-compressing melody samples using digital signal processing (DSP), and/or by controlling the speed at which MIDI control messages are processed. For example, the musical synthesis module 118 can use the time-scaling technique to shorten or lengthen melody samples without changing pitch (tempo manipulation).

In some embodiments, the music synthesis module 118 may select and playback alternate audio content provided in the music container of the object to improve these various manipulations to create high quality melody samples.

In some embodiments, the music synthesis module 118 can be configured to drag the current musical composition to the tempo, feel, key, and mode of a newly deployed object. In this configuration, the music synthesis module 118 in effect sets the newly deployed object as the master of one or more of those parameters. In some cases, the music synthesis module 118 can be configured to drag an individual object of the musical composition to the tempo, feel, key, and mode of a newly deployed object when that individual object is not the master of one of more of those parameters.

In step 510, the musical synthesis module 118 can be configured to generate a transition sequence that bridges the current musical composition and the target musical composition that matches the tempo, feel, key, and mode of the newly deployed object. A transition sequence is a special sequence of music and events that is used to create a smooth musical transition between the current musical composition and the target musical composition. The transition sequence functions similarly to a "riser" (e.g., the transition) that leads into a "drop" (e.g., a big change in music) commonly heard in electronic dance music. This allows the musical synthesis module 118 to create an aesthetically pleasing musical transition from one tempo, feel, key, and/or mode to another.

In some embodiments, the musical synthesis module 118 is configured to generate the transition sequence that includes a ramping from the original tempo/feel to the new tempo/feel, and/or an insertion of transitional key or chord changes to move from the original key/mode to new key/mode. For example, when a master object is deployed, the musical synthesis module 118 can generate a specific transition sequence (typically 2 to 4 bars in length) that acts as the "riser" (e.g., the transition) that leads into the "drop" (e.g., a big change in music such as the target music associated with the master object). In some embodiments, the specific settings unique to each transition sequence are described in the transition's MIDI file, via MIDI notes and/or MIDI text events.

Once the transition sequence is available, the musical synthesis module 118 is configured to start the transition sequence, as specified by wild object, in the next bar boundary.

In some embodiments, the musical synthesis module 118 is configured to generate a transition sequence through a dynamic manipulation of melody samples over time using the audio processing techniques described above. For example, the musical synthesis module 118 may apply DSP effects (e.g., filtering, "flanging", stutter echo) to the synthesized musical composition to create an accelerando (e.g., speeding up or slowing down) effect for the duration of the transition. As another example, the musical synthesis module 118 can be configured to dynamically manipulate the signal gain over time to provide smooth transitions. The musical synthesis module 118 may synchronize these musical and/or DSP transitions to occur at musically relevant moments which, in contemporary music, typically fall on bar boundaries, such as 4-bar boundaries, 8-bar boundaries, and/or section boundaries. Once the musical synthesis module 118 completes the transition sequence generation, all of the playing musical contents will be synchronized to a new tempo, feel, key and/or mode, and the musical clock may be reset.

In some embodiments, in step 510, the musical synthesis module 118 is configured to stutter (or loop) any currently playing musical composition from other object(s) at interval(s) specified by the transition sequence. Then the musical synthesis module 118 is configured to start a tempo ramp from the tempo of the existing musical composition to the tempo associated with the object as specified by transition sequence.

In some embodiments, some musical containers are authored such that they can start on any bar boundary. Some are authored such that they sound best if started on specific bar boundaries. Some are authored with an anacrusis ("pick-up"), and should therefore be started mid-bar. The pick-up marker includes a MIDI text event on a musical timeline that marks an available place where a piece of music can start playing. The musical synthesis module 118 and step 510 may consider this authoring "mark-up" as the musical synthesis module 118 determines how to render the transition sequence.

In step 512, the musical synthesis module 118 is configured to synchronize the object's clock to the game clock, and proceed to step 514.

In step 514, the musical synthesis module 118 is configured to play the specific music associated with the object, based on the object type and where the object is played on the music mix layout. In order to determine when the music should begin, the musical synthesis module 118 is configured to determine whether the object is a wild object type. As discussed above, some musical containers are authored such that they can start on any bar boundary; some are authored such that they sound best if started on specific bar boundaries; and some are authored with an anacrusis ("pick-up"), and should therefore be started mid-bar. When the object is not a wild object, the musical synthesis module 118 is configured to begin music at the next bar boundary or "pickup" marker, whichever occurs first. When the object is a wild object, the musical synthesis module 118 is configured to consider this authoring "mark-up" as the musical synthesis module 118 determines how to render the transition sequence. For example, the musical synthesis module 118 can be configured to begin the music associated with a musical container at the beginning of a bar or at the nearest "pick-up" marker depending on the type of the music associated with a musical container.

In some embodiments, the musical synthesis module 118 is configured to dynamically control the volume (e.g., the loudness) of the currently playing musical composition to create an aesthetically pleasing musical mix. It may also accentuate changes to the musical composition (made as a result of user action), by applying DSP and/or boosting the volume of the appropriate musical container(s) for some period of time, and optionally modifying the other playing containers during that same period to divert attention toward the change in the musical composition.

In some embodiments, the musical synthesis module 118 is configured to stop the musical composition. When an object exits from the musical composition, by being removed from gameplay or replaced by another object, the musical synthesis module 118 is configured to stop the music as specified by the object.

Figure 6A:
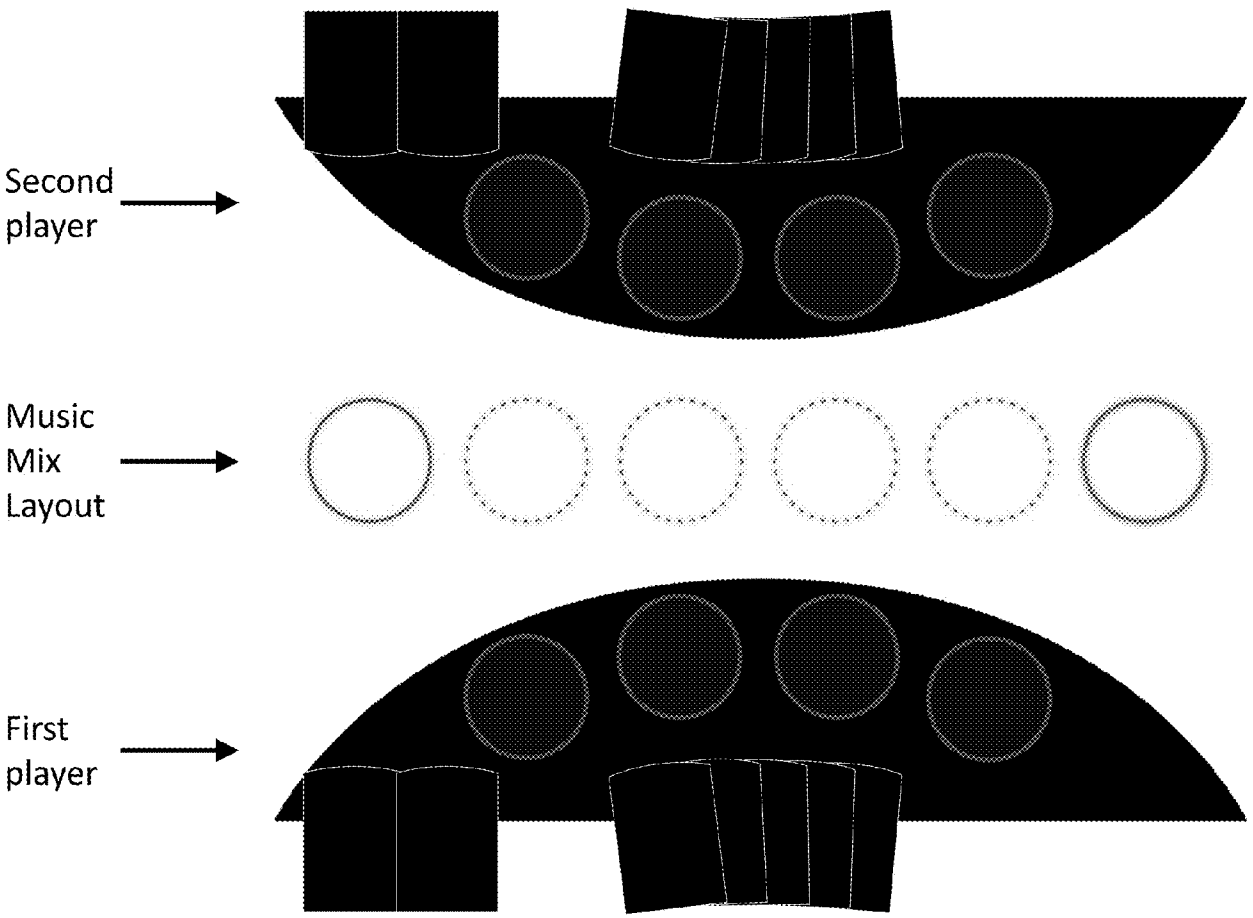
FIG. 6A-6D illustrate a set-up and rules for a gameplay in accordance with some embodiments.

In some embodiments, the musical synthesis module 118 can accommodate a gameplay between two or more players. In some cases, the two or more players can collaborate with one another to create a musical composition. In such cases, the musical synthesis module 118 can implement gameplay rules that determine how the players should collaborate to create the musical composition. In other cases, the two or more players can compete with one another to control the musical composition created through the gameplay. FIG. 6A illustrates a set-up for a gameplay between two players in accordance with some embodiments.

Figure 6B:
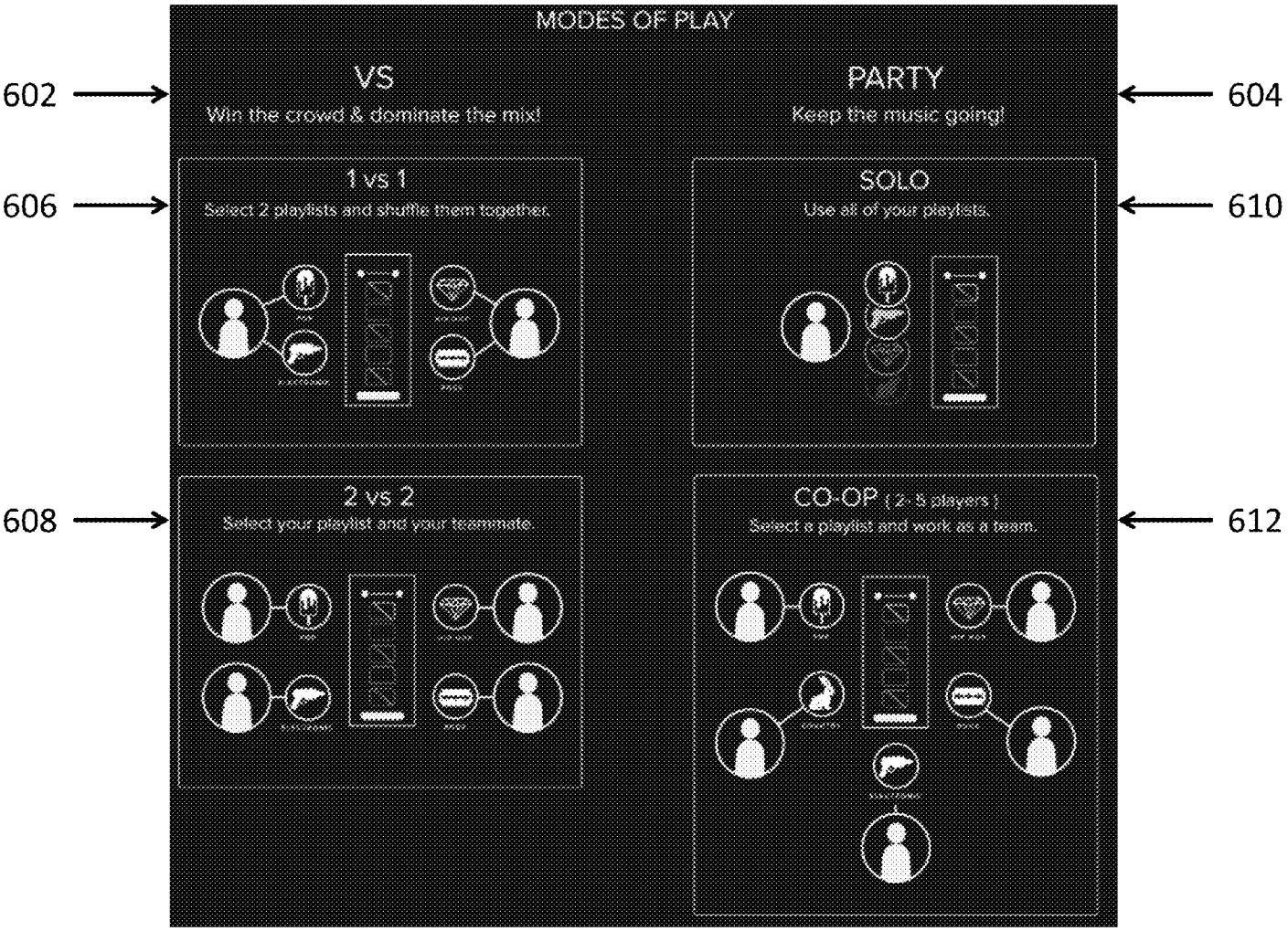

FIG. 6B illustrates a variety of music synthesis modes in accordance with some embodiments. The music synthesis module 118 can be configured to support a clash mode 602 and a party mode 604. In the clash mode 602, the music synthesis module 118 is configured to provide a gameplay in which two or more teams compete to become the first one to score a predetermined number of points by getting its music into the musical composition. In the party mode 604, the music synthesis module 118 is configured to provide a gameplay in which two or more players collaborate as a team to respond to the crowd's request and score points.

Figure 6C:
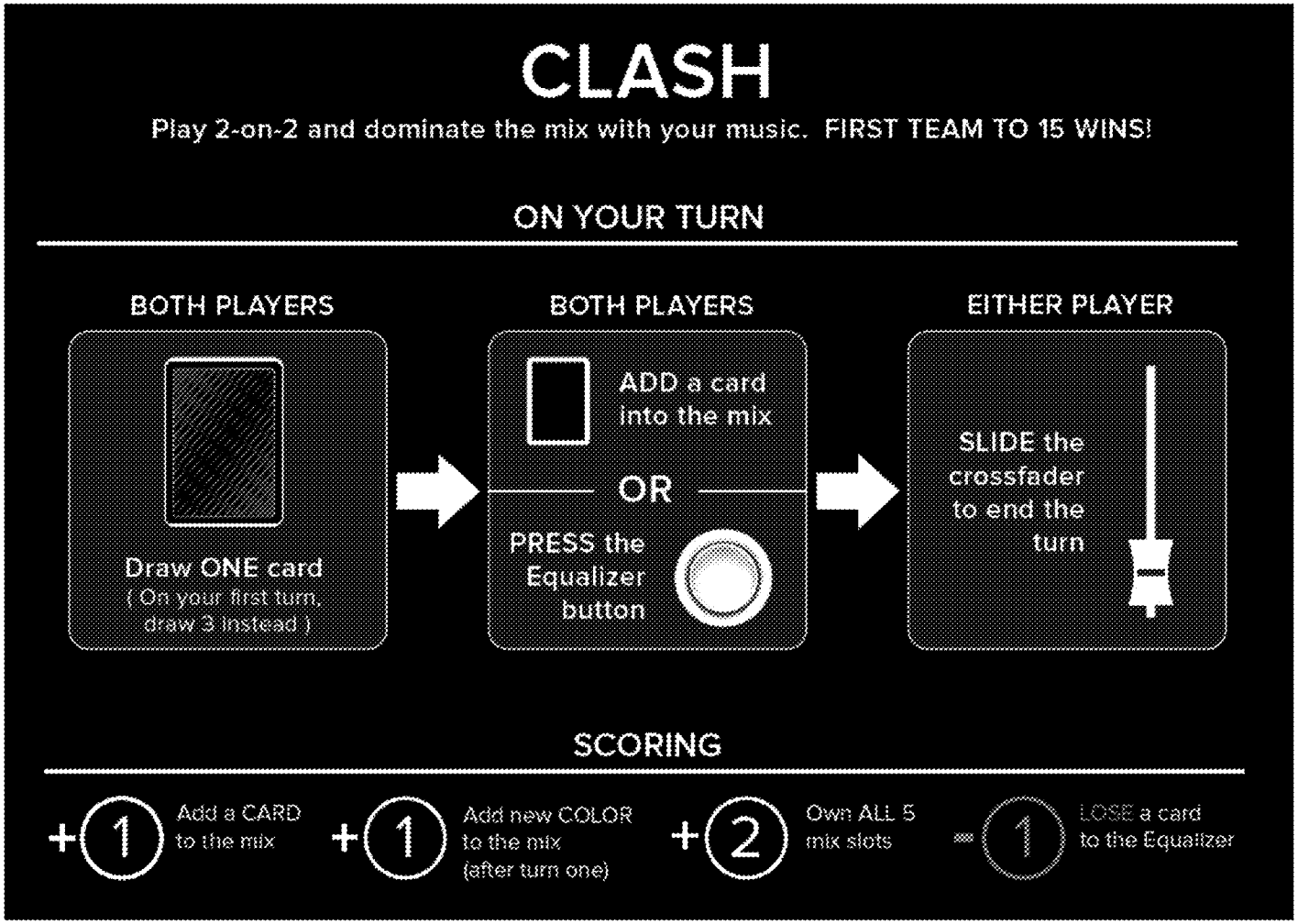

FIG. 6C illustrates a clash mode of the music synthesis module 118 in accordance with some embodiments. In some embodiments, in a clash mode 602, the music synthesis module 118 can divide the players into a first team and a second team. The one-on-one clash mode 606 refers to a scenario in which each team includes a single player; the two-on-two clash mode 608 refers to a scenario in which each team includes two players. The clash mode 602 can support any number of players in each team.

Initially, the music synthesis module 118 is configured to assign a predetermined number of cards to each player. For example, in the two-on-two clash mode, the music synthesis module 118 is configured to assign 15 cards per player. At the start of the clash mode, the music synthesis module 118 is configured to direct each player to shuffle their deck of cards, place the deck face down, and draw a predetermined number of cards (e.g., 2 cards). Then, the music synthesis module 118 is configured to randomly select one of the teams to go first, and causes the one or more audio/video devices 114 to light up the playing team's side of the music mix layout.

As the gameplay starts, the music synthesis module 118 can be configured to direct each player to draw a card. Then the music synthesis module 118 can direct each player to perform one of the following actions:

- Play a card from its hand into a matching colored music mix slot. If the slot is occupied, the player must play a card of equal or higher Level to take control of the music mix slot. A player earns 1 point for each card played.
- Press the Equalizer (EQ) button. The EQ is a wheel that spins and randomly selects Level 1, 2, 3, or nothing. If it lands on a Level value, the opposing team or player should clear any music mix slot it controls of that value. A player loses 1 point for each card cleared.

When a team has taken a predetermined number of actions (e.g., 2 actions), the music synthesis module 118 automatically terminates the turn for that team, and provides the turn to the other team.

In some embodiments, after the first turn, if one of the music slots is not represented in the music mix layout, the music synthesis module 118 can provide one bonus point to a player that places a card to that slot. In some embodiments, if a team takes control of all music slots on the music mix layout, then the team earns 2 bonus points.

Figure 6D:
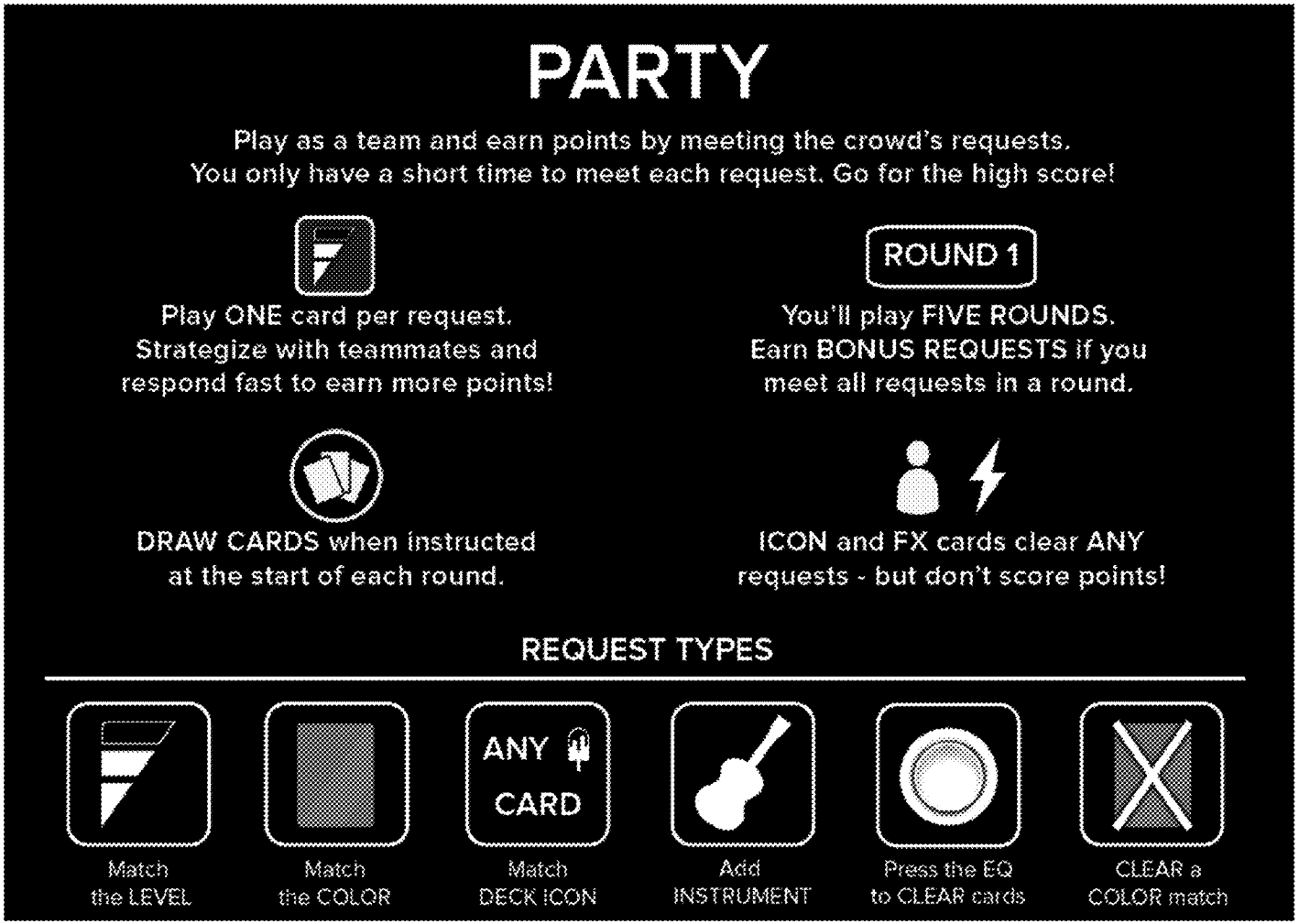

FIG. 6D illustrates a party mode of the music synthesis module 118 in accordance with some embodiments. In some embodiments, the music synthesis module 118 can support a solo party mode 610 or a multi-player party mode 612. In the party mode 604, the music synthesis module 118 can provide each player with a predetermined number of cards (e.g., 15 cards.) At the start of the game, the music synthesis module 118 can direct each player to shuffle its deck, place it face down, and draw a predetermined number of cards (e.g., 3 cards).

In some embodiments, in the party mode 604, the music synthesis module 118 provides a gameplay that includes five rounds, with opportunities to earn additional encore rounds. Each round includes a fixed number of requests. A request includes a prompt for a player to add a card to the music mix layout or perform another action. A request can be one of the following types:

Play a card of a certain color.

Play a card of a certain level.

Play a card of a certain instrument type.

Remove a card of a certain color.

Press the EQ button and clear any cards it indicates.

The music synthesis module 118 is configured to enable players to deploy their cards into matching colored music mix slots. If a mix slot is occupied, the music synthesis module 118 is configured to direct a player to play a card of equal or higher Level to add its card to the music mix layout and score points. In some cases, an outstanding request can be valid only for a limited time. In this case, the faster a player satisfies a request, the more points it earns. If a player does not meet the request, the music synthesis module 118 is configured not to award points to the player.

In some embodiments, when a player satisfies all requests in a round, the music synthesis module 118 is configured to provide a chance, to the player, to meet a bonus request and score extra points. In some embodiments, when a player satisfies all bonus requests in the five rounds, the music synthesis module 118 is configured to provide a chance, to the player, to play an encore round.

In some embodiments, the platform (e.g., the musical synthesis module 118) can implement various gameplay rules. These rules can be different from the musical containers associated with cards. Each player can start with, for example, 30 shuffled cards taken from each player's full card selection. The shuffle can ensure that each player does not know what cards are coming up next. The platform can also require that each player takes alternate turns during play or synthesis. The duration of each turn can be limited, for example, based on the number of cards played, a predetermined time, and/or the number of musical bars in the existing musical composition.

When a player deploys a new card, the player can add the new card to the music mix layout 200, or place the new card on an old card that is already in the mix to modify or replace the old card. In response, the musical synthesis module 118 can modify the musical composition in accordance with the new card, as described previously. For example, the musical synthesis module 118 can modify the musical composition based on one or more attributes associated with the new card. As another example, the musical synthesis module 118 can modify the musical content of the old card based on one or more attributes associated with the new card.

In some embodiments, the musical synthesis module 118 may allow only one bassline card to be deployed at a time. To this end, the musical synthesis module 118 may work with a music mix layout 200 that has a single dedicated slot for a bassline card, or can be configured to indicate that two bassline cards played in different slots is an improper move. Also, when two or more cards are vying for the same slot, the gameplay rules can be configured such that only a card with a higher power can be played on an existing card in a slot, and the musical synthesis module 118 can be configured to deploy the card with the highest power. In some cases, when a mute card is placed on a slot with an existing card, the musical synthesis module 118 can mute the effect of the existing card on the musical composition.

In some embodiments, the musical synthesis module 118 can determine a score for each player based on the status of cards on the music mix layout 200 and/or the ownership of cards placed on the music mix layout 200. The musical synthesis module 118 can terminate a gameplay once the game reaches a predetermined condition. For example, the musical synthesis module 118 can terminate a gameplay when one of the players reaches a target condition, such as a target score, a target duration, or a target difference between scores of players.

Figure 7:
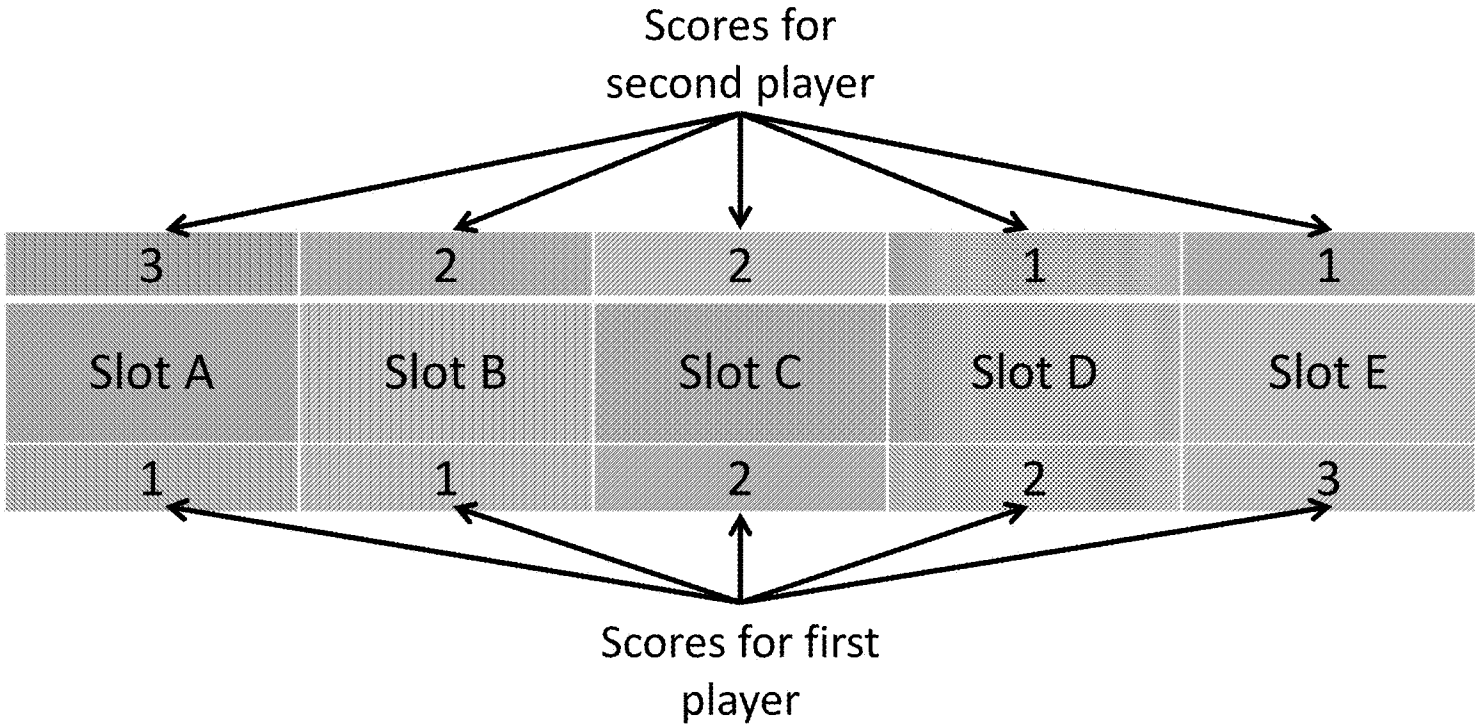
FIG. 7 illustrates that slots in a music mix layout may provide different scores for different players in accordance with some embodiments.

For example, the goal of a gameplay for a player is to reach a predetermined score before other players in the gameplay. The music mix layout 200 can include a plurality of slots, e.g., five slots. When a player places a card at a slot, the player can earn the score associated with that slot. The slots can be worth different scores for different players. FIG. 7 illustrates that slots in the music mix layout 200 may be associated with different scores for different players in accordance with some embodiments. In some examples, FIG. 7 can be a representation of a physical mix layout or a virtual mix layout.

When players are ready to play the game, the players can shuffle the card deck and randomly select a player to make the first move (e.g., or if playing virtually, the platform can shuffle the card deck and/or randomly select cards for each player). That player can draw a predetermined number of cards (e.g., 3), and the other player(s) can subsequently draw a predetermined number of cards (e.g., 5).

In each turn, the musical synthesis module 118 can allow each player to take a predetermined number of actions (e.g., 2 actions). An action can be one of the following:

Play a Card: Play one card into an empty or filled slot. To play into a filled slot, the power of the card must be equal to or greater than the power of the card in the slot.

Silence a Card: Discard one card from the hand to remove a card from the mix.

Draw Cards: Draw two cards.

Mulligan: Discard the card(s) from the hand and re-draw the same number of cards.

The musical synthesis module 118 can allow a player to perform the same type of actions multiple times within the same turn. For example, a player may play a first card into an empty slot A, and then play a second card into an empty Slot B. As another example, a player may draw two cards, and then draw two more cards. This would count as two actions. However, the musical synthesis module 118 may not allow a player to perform two actions on the same slot. For example, a player cannot silence the existing card on Slot B and then play a new card into Slot B in the same turn.

After each turn, the musical synthesis module 118 can accumulate scores for all slots that are controlled by the player, using the point values associated with that player. The musical synthesis module 118 can terminate the gameplay when the player garners a predetermined number of points (or more) at the end of their turn. In some embodiments, when a player has more than a maximum allowable number of cards in hand at the end of the turn, the musical synthesis module 118 can require the player to discard one or more cards so that the total number of cards in hand does not exceed the maximum allowable number of cards.

In some embodiments, the musical synthesis module 118 may restrict an order in which a player can place cards in the music mix layout 200. For example, the musical synthesis module 118 can require a player to fill the empty slots from left to right, and the musical synthesis module 118 may prohibit overwriting or muting cards that the player cannot reach. Therefore, the musical synthesis module 118 may impose a rule that in order to reach a slot, all of the slots to its left must be filled.

In some embodiments, the musical synthesis module 118 may also impose rules on the music mix layout 200 itself. For example, the musical synthesis module 118 may require that the music mix layout 200 should not contain more than a predetermined number of music samples, and that only one of them can be exclusive. The musical synthesis module 118 may also require that the music mix layout 200 has no more than two cards associated with beats and that the music mix layout 200 has no more than one card associated with a bassline.

Figure 8A:
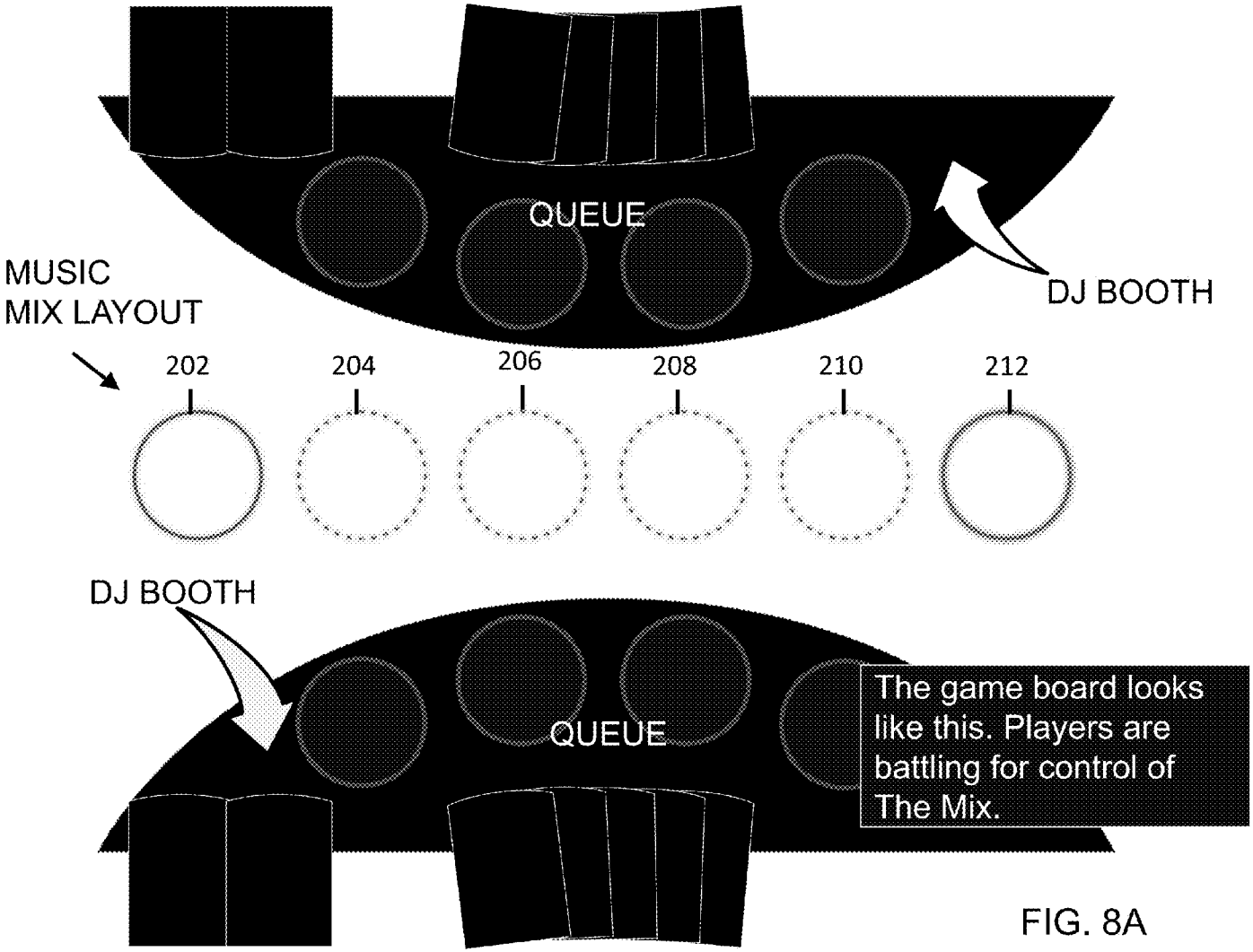
FIGS. 8A-8N illustrate a progression of a gameplay in accordance with some embodiments.
Figure 8B:
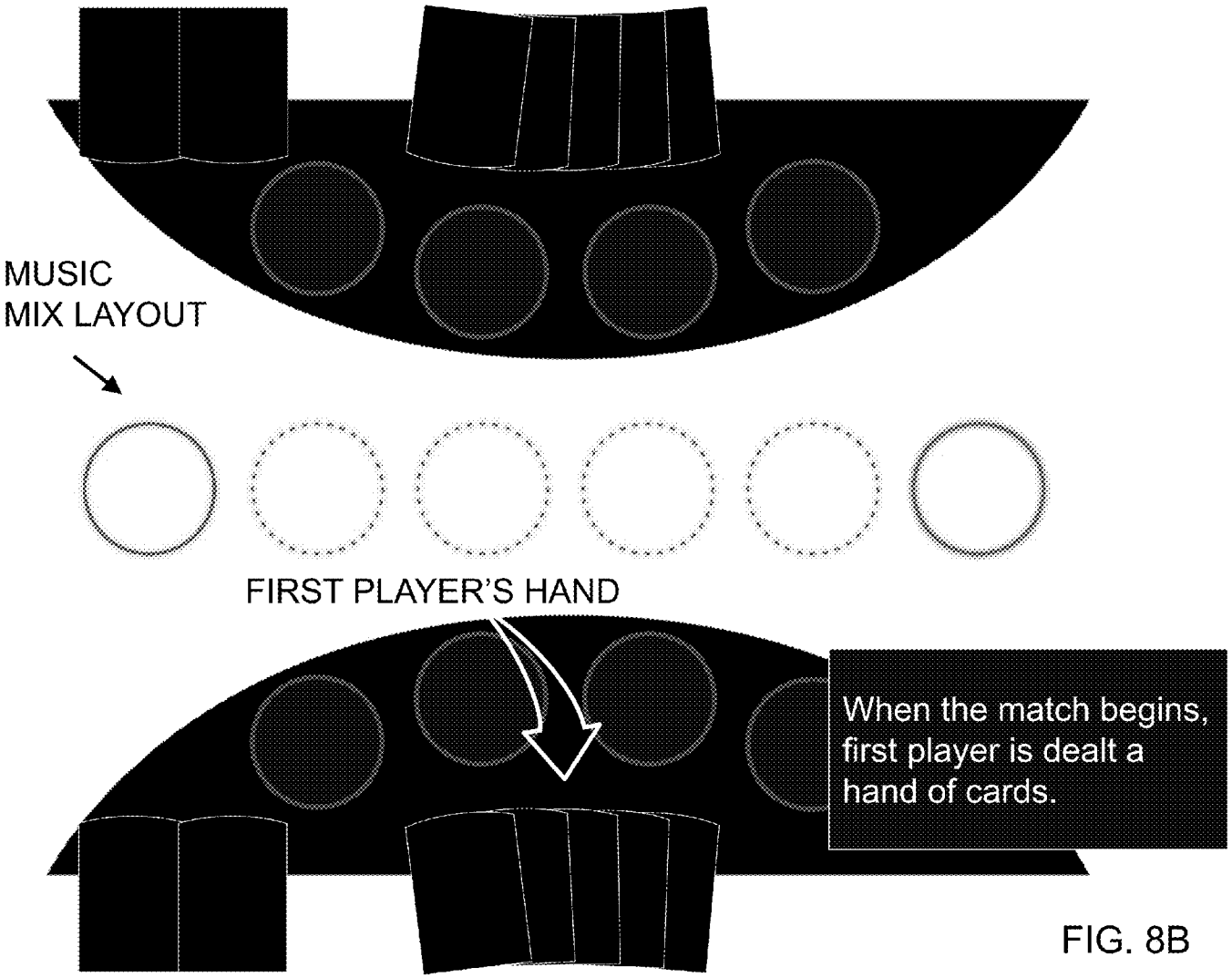
Figure 8C:
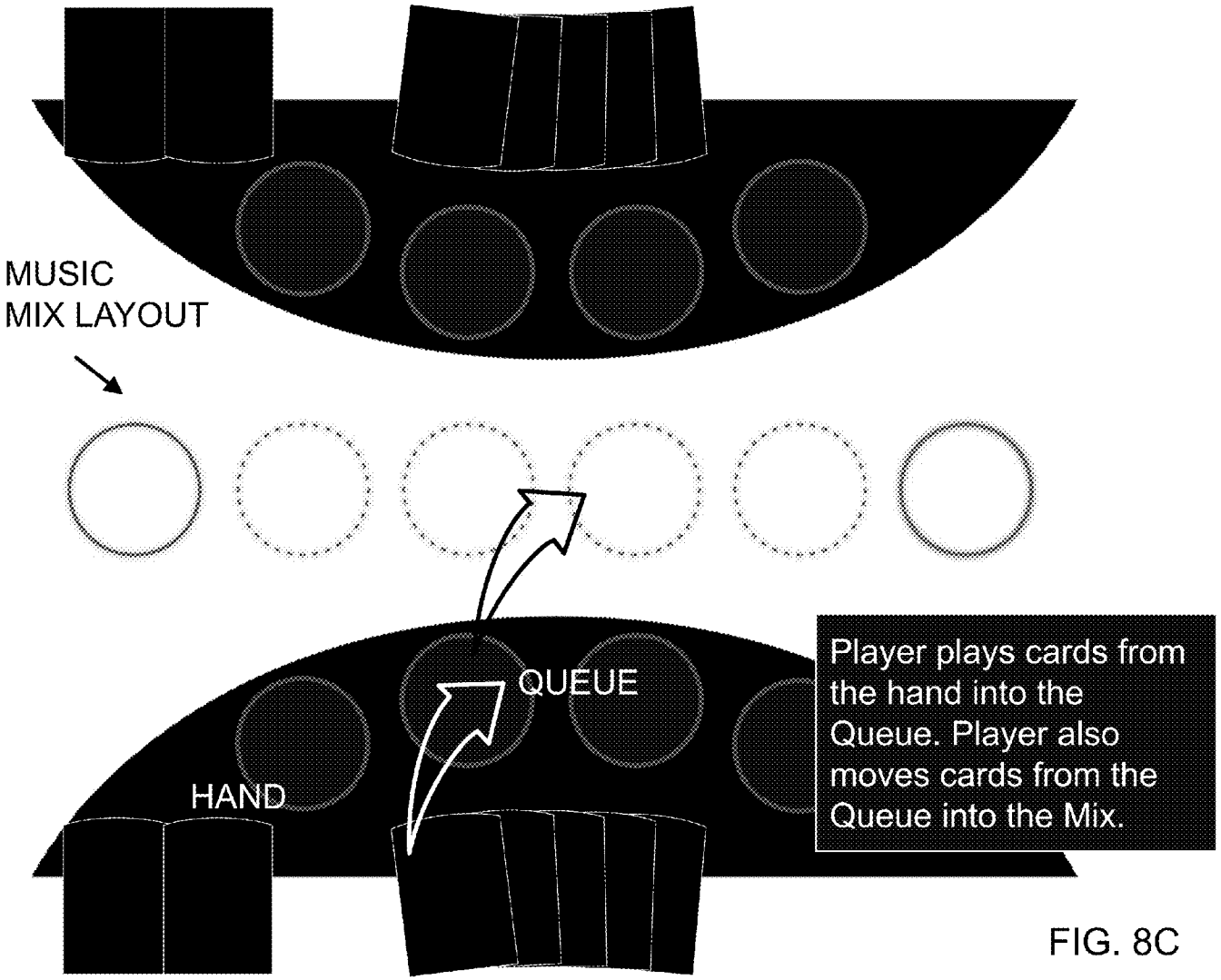
Figure 8D:
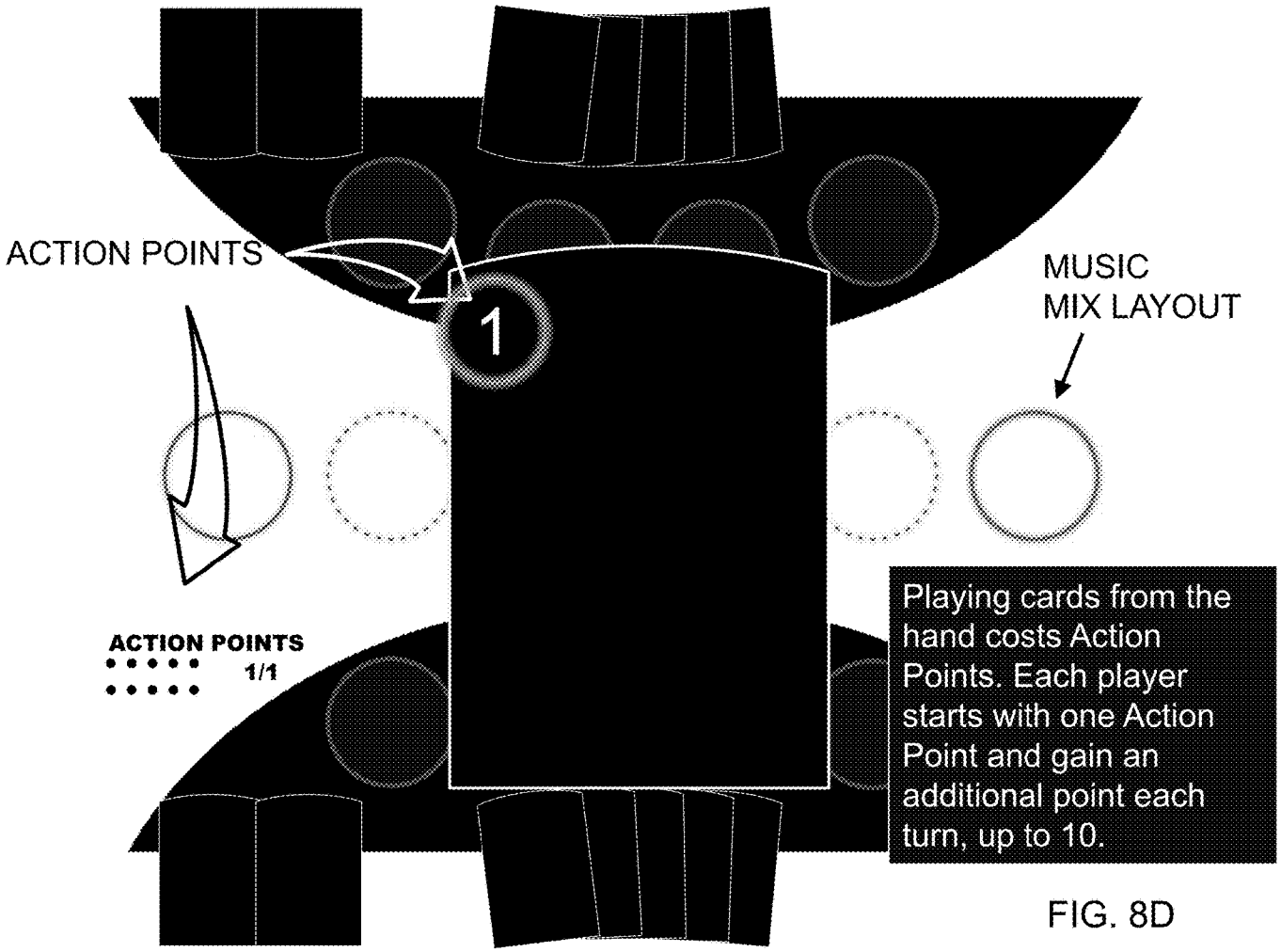
Figure 8E:
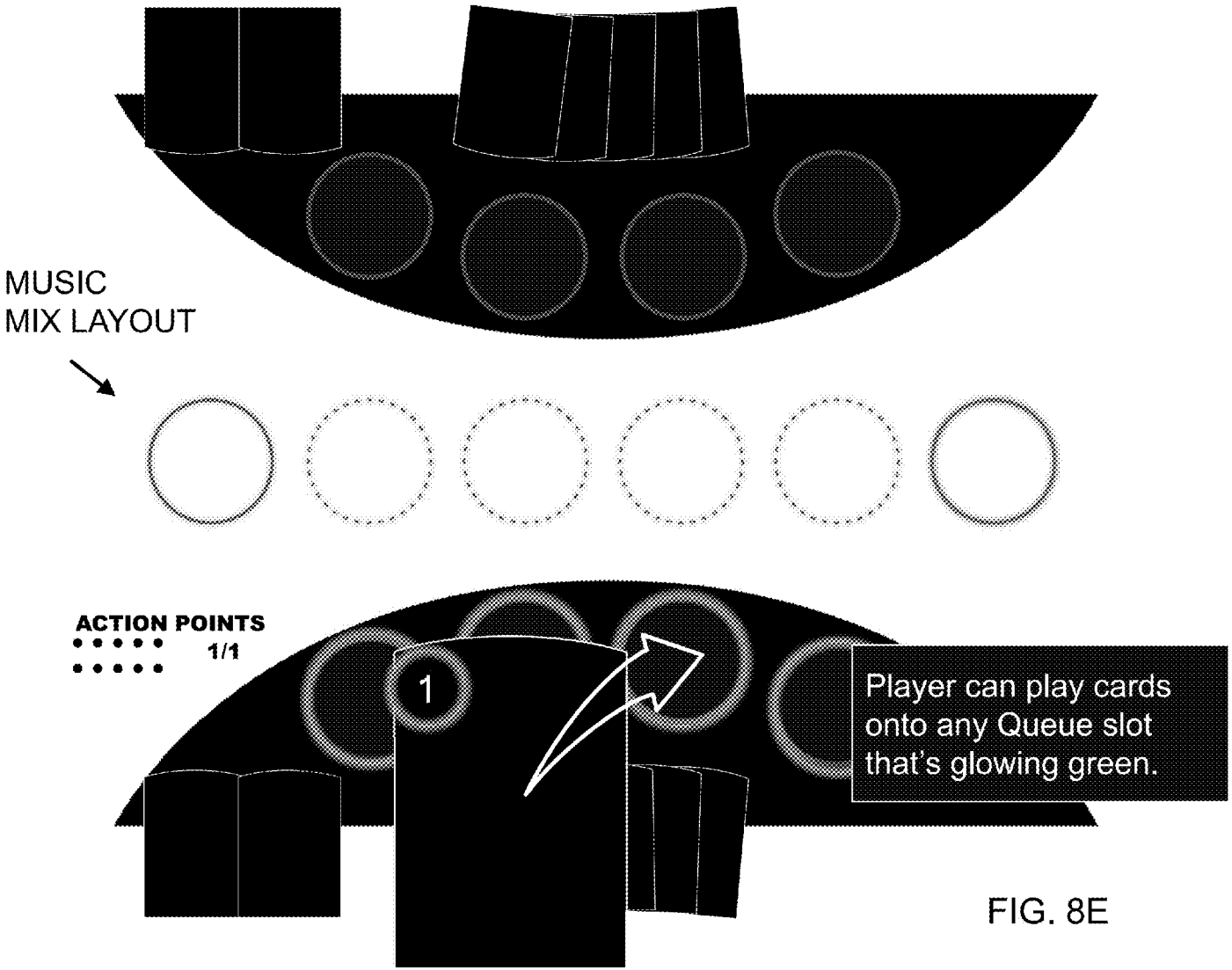
Figure 8F:
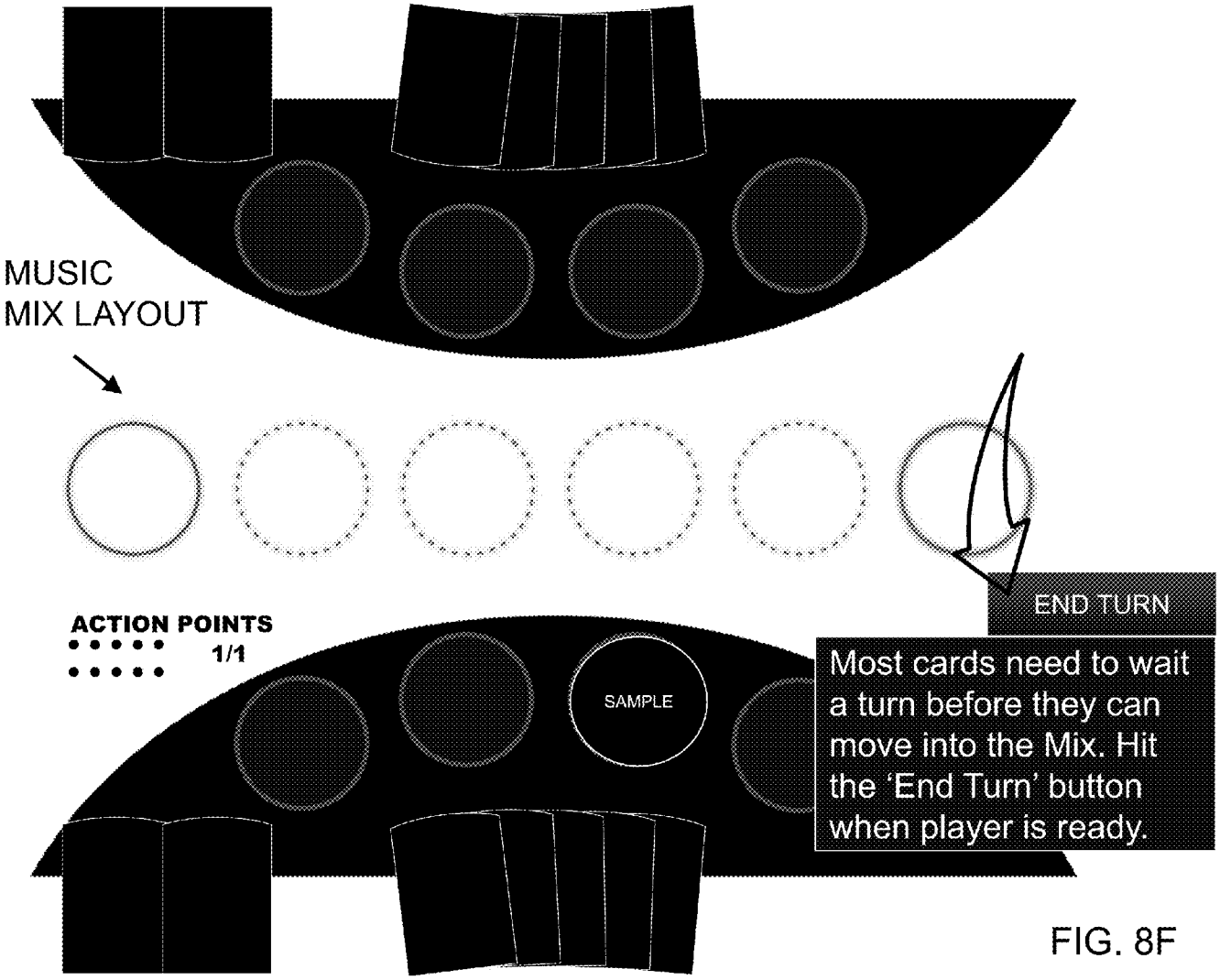
Figure 8G:
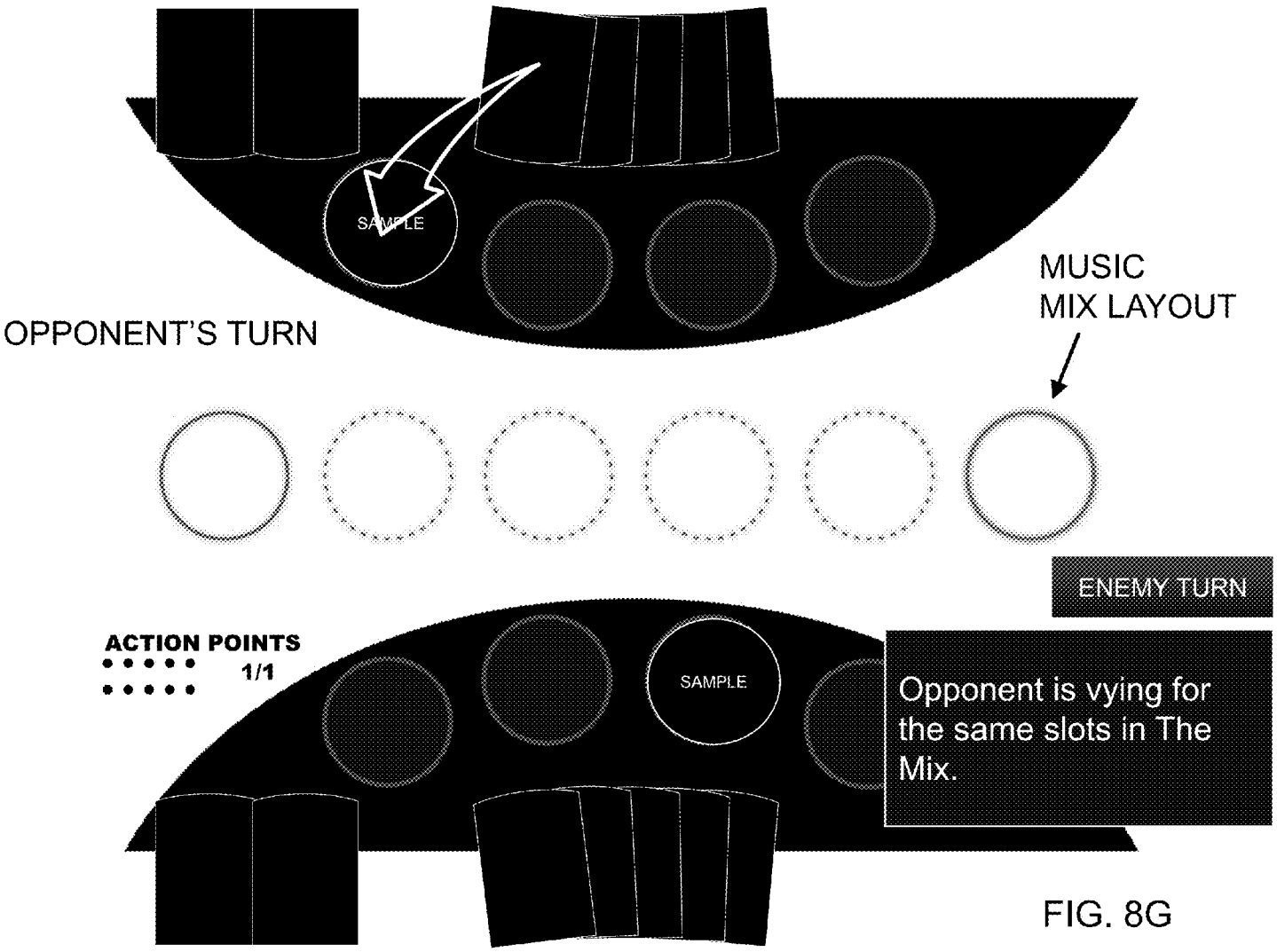
Figure 8H:
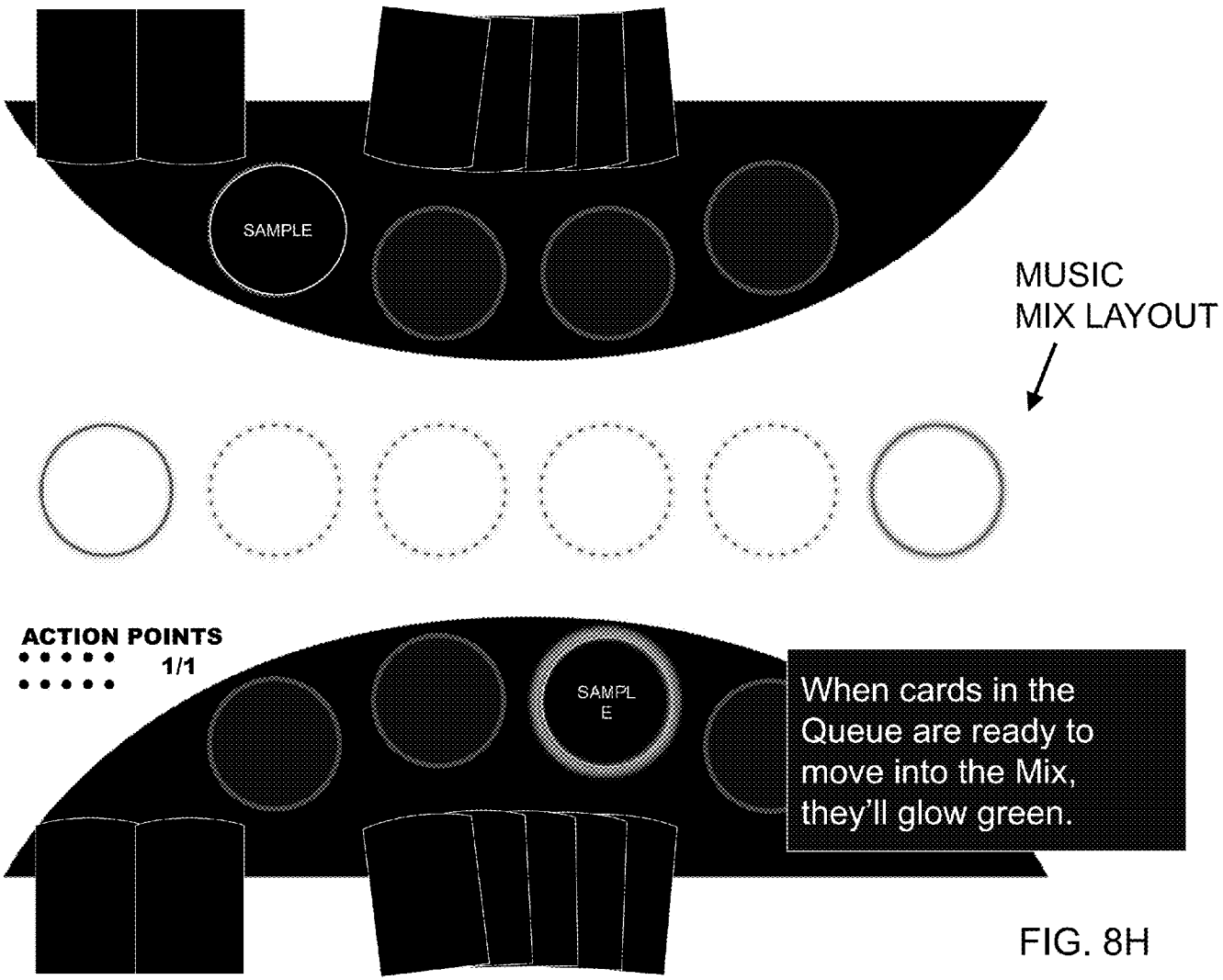
Figure 8I:
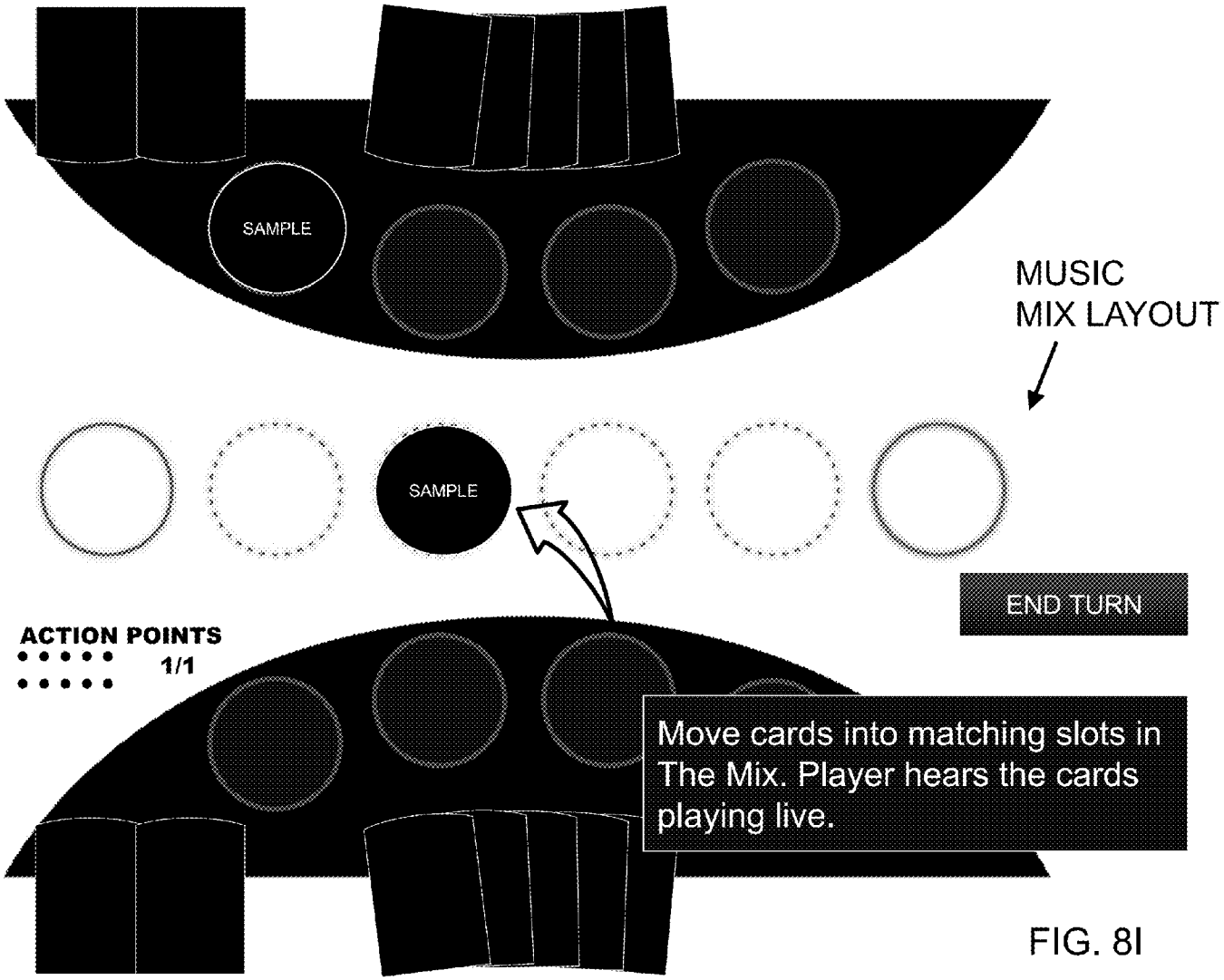
Figure 8J:
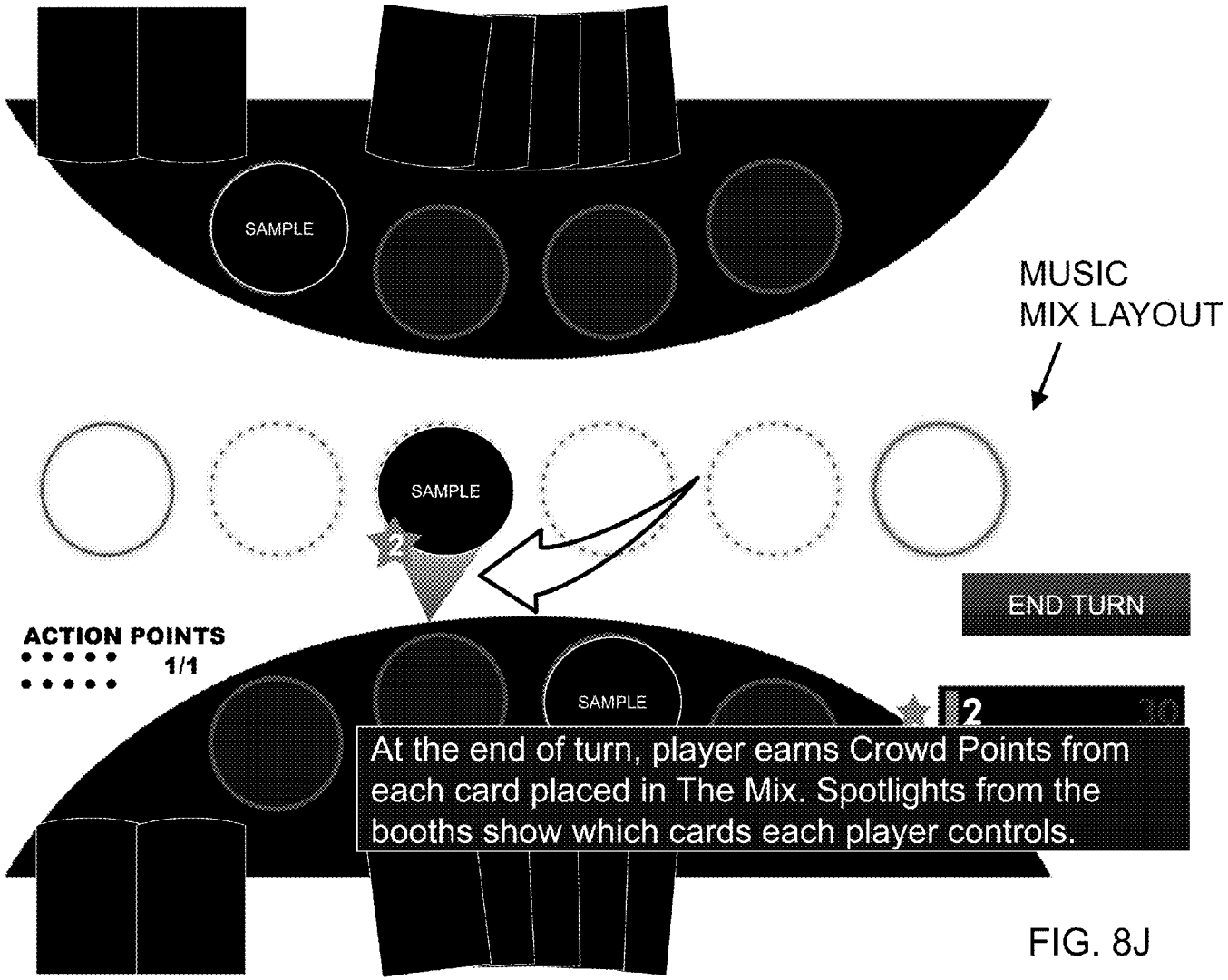
Figure 8K:
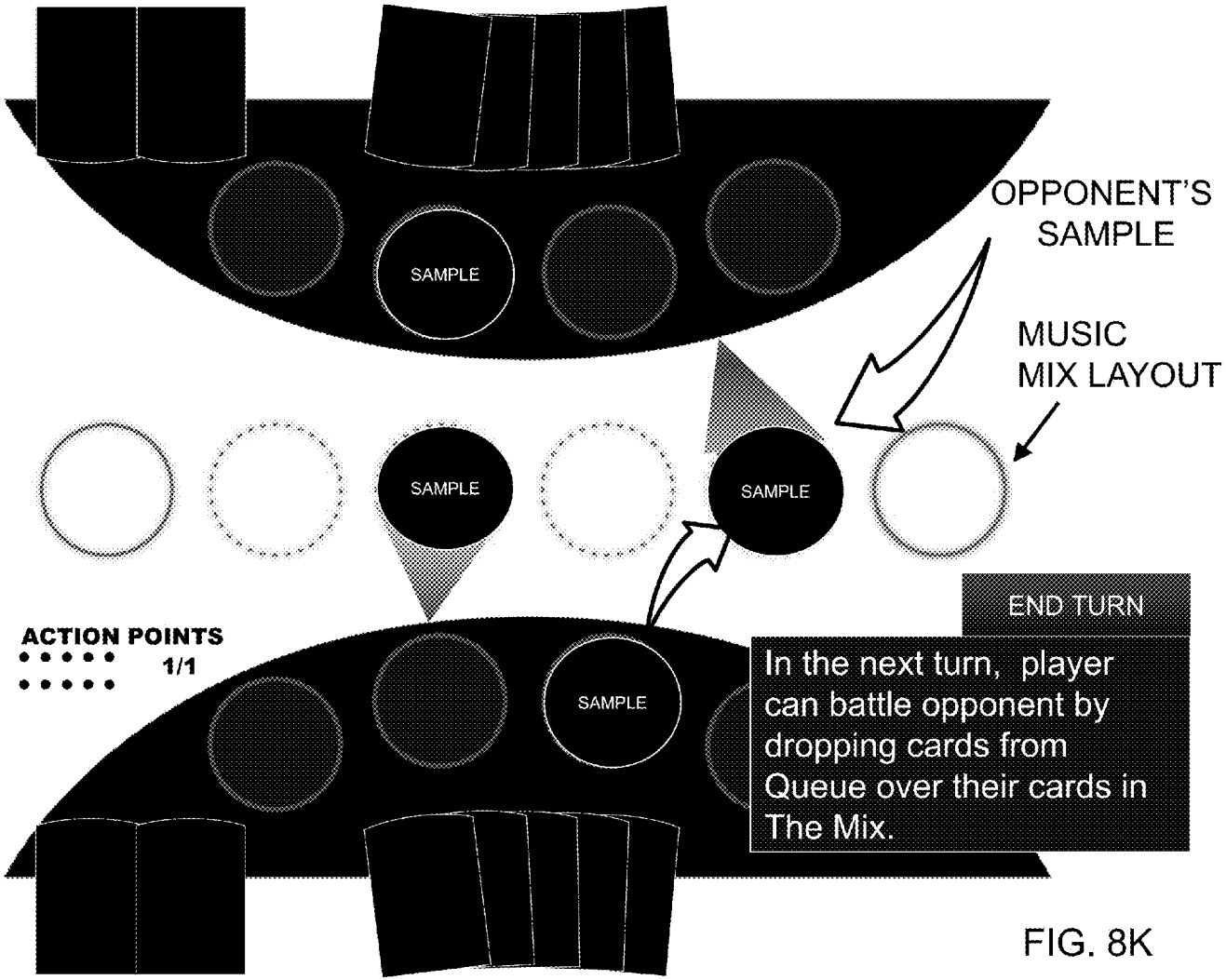
Figure 8L:
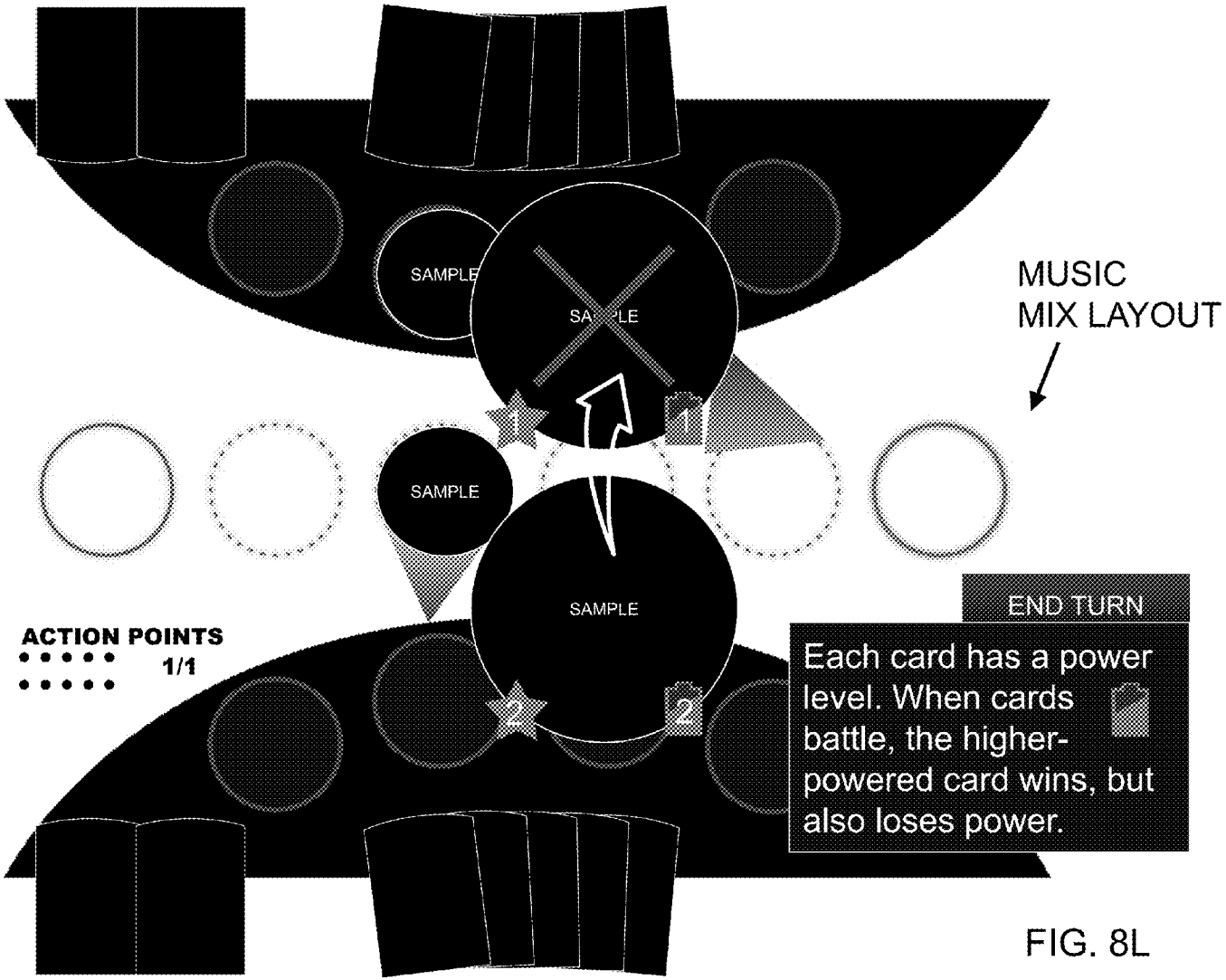
Figure 8M:
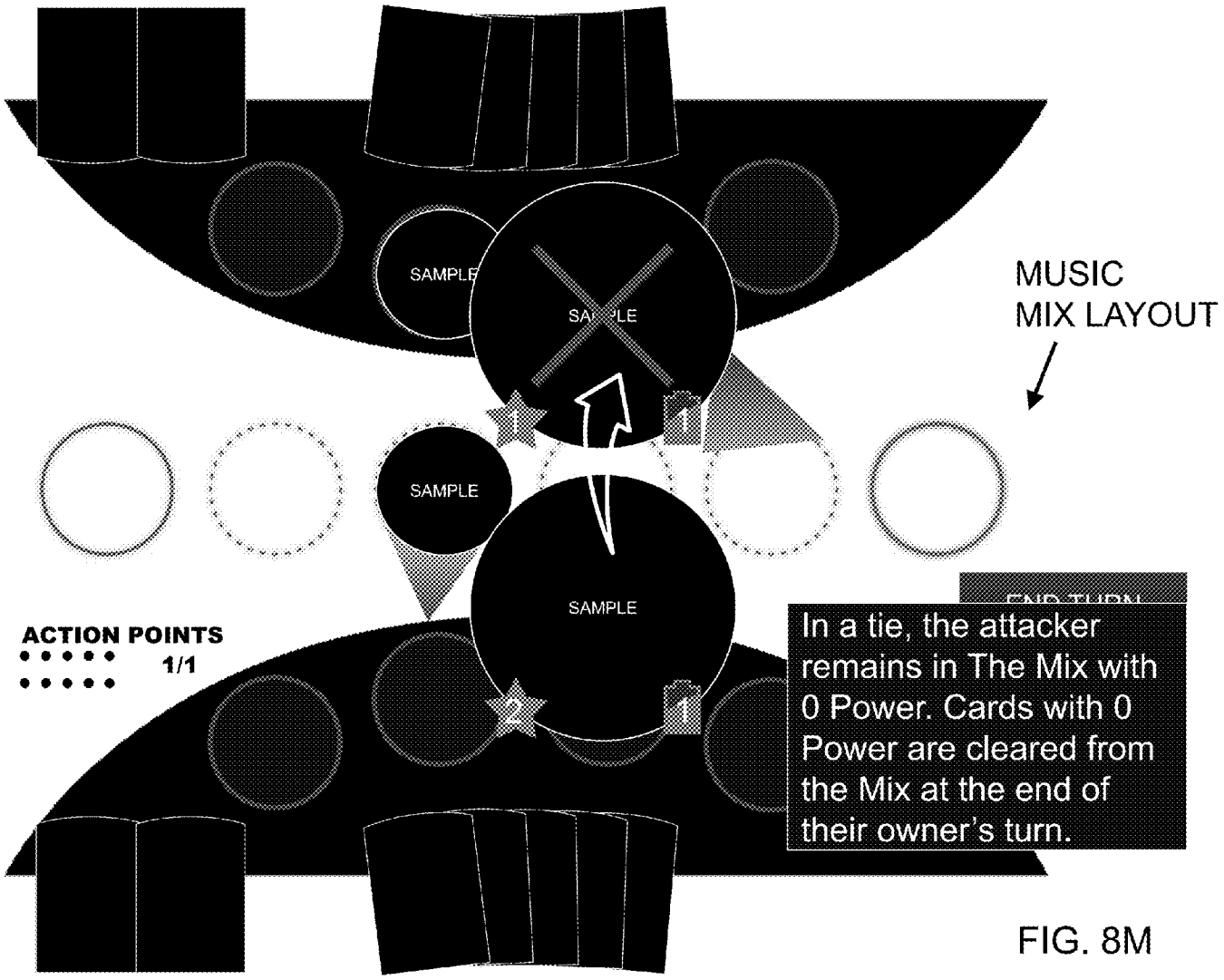
Figure 8N:
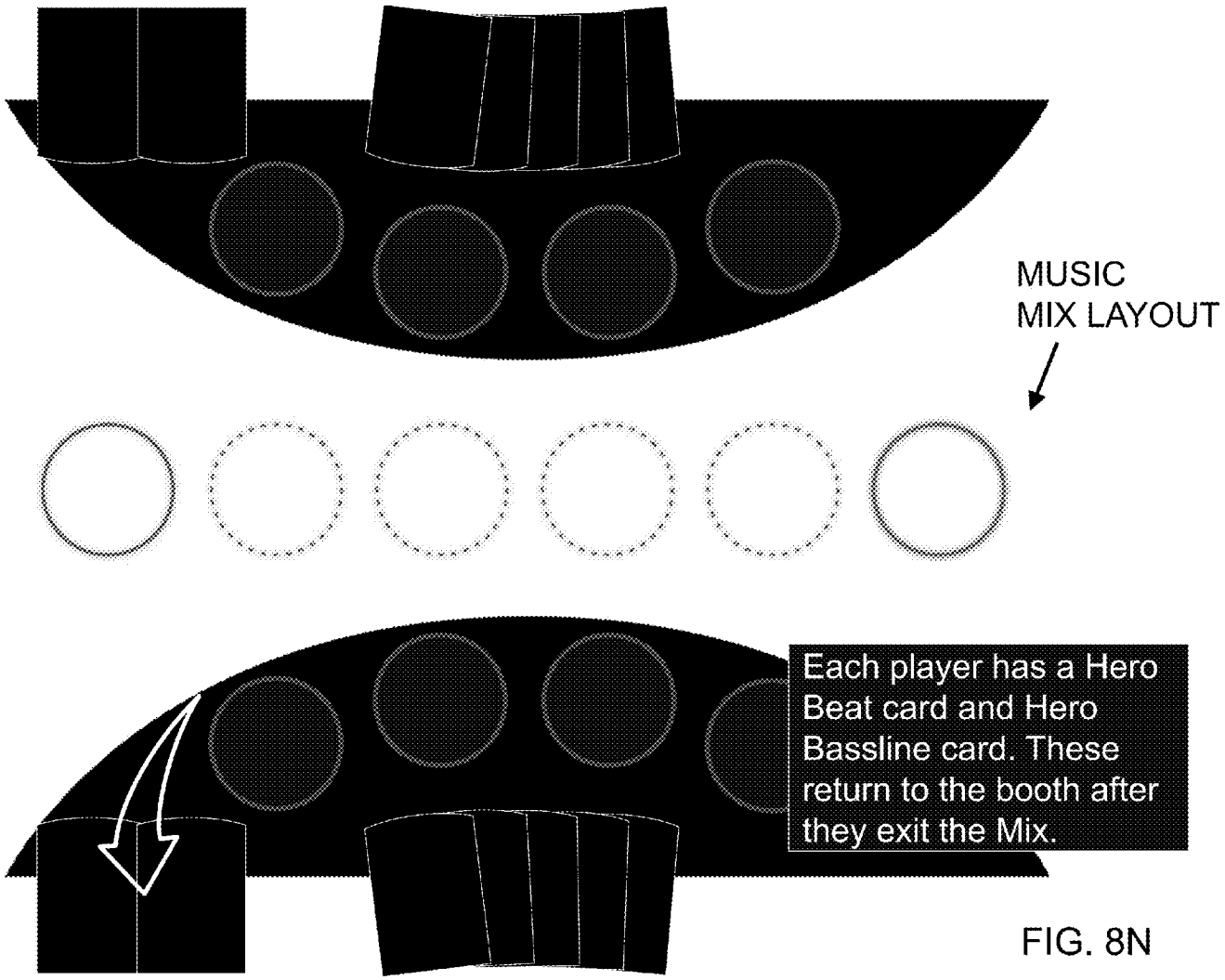

FIGS. 8A-8N illustrate a progression of a gameplay in accordance with some embodiments. In FIG. 8A, when players enter a gameplay, each player can receive a DJ booth and a hand of cards. Each DJ booth can include a queue on which a player can place cards from the hand. The music mix layout 200 can include a plurality of slots (202, 204, 206, 208, 210 and 212), one or more of which can be dedicated to a particular type of card. For example, the slot 202 is dedicated to a beats card that controls the beat of the musical composition. As another example, the slot 212 is dedicated to a bassline card that controls the bassline of the musical composition.

In FIG. 8B, when the gameplay begins, the first player is dealt a hand of cards. In this case, the first player receives five cards. In FIG. 8C, during the first player's turn, the first player can place one or more cards from the hand into the queue, and move one or more cards from the queue, if available, to the music mix layout 200. In some embodiments, as shown in FIG. 8D, the musical synthesis module 118 can deduct action points from a player when the player plays a card from the hand. The musical synthesis module 118 may credit each player with one action point in the beginning of the game, and may gain up to 10 action points during the gameplay. As shown in FIG. 8E, the musical synthesis module 118 can indicate the queue in which the player can place the card from the hand.

In FIG. 8F, once the player completes the turn, the player can indicate it by clicking on an "end turn" button (e.g., a space bar on a keyboard). In FIG. 8G, the turn is handed over to the opponent. In this gameplay, the opponent is also vying to place her/his card onto one of the slots in the music mix layout 200.

When the turn is handed over to the original player, the musical synthesis module 118 can indicate to the original player that one of the cards in the queue can be moved into the music mix layout 200. In FIG. 8I, once the player places one of the cards into the music mix layout 200, the musical synthesis module 118 can play the musical content associated with the placed card in real time.

In FIG. 8J, at the end of the turn, the player can earn a score (also called Crowd Points) from each card placed in the music mix layout 200 and owned by the player. In some embodiments, the musical synthesis module 118 may indicate the ownership of cards in the music mix layout 200 using spotlights.

In FIG. 8K, in subsequent turns, the player can battle the opponent by placing cards over the opponent's card in the music mix layout 200. As shown in FIG. 8L, each card may be associated with a power level. When two cards are in a battle, the card with a higher power level would prevail, but would also lose power commensurate with the opponent's card. For example, suppose that the first player's card has a power of 5, and the second player's card has a power of 3. When these two cards are in a battle, the first player's card would prevail, but the power level associated with the first player's card would be reduced to 2. As shown in FIG. 8M, when two cards in a battle have the same power level, the attacking card will replace the card that was originally in the music mix layout 200. However, because the attacking card would have the power level of 0, the attacking card will be removed from the music mix layout 200 once the attacking player's turn is over. As shown in FIG. 8N, the musical synthesis module 118 may provide each player with a hero beat card and a hero bassline card. When these cards are removed from the music mix layout 200, these cards will return to the booth.

In some embodiments, a card may be associated with intro musical content. In this case, when the card is in the queue, the musical synthesis module 118 can play the intro musical content. In some embodiments, a card may be associated with outro musical content. In this case, when the card exits the music mix layout 200, the musical synthesis module 118 can play the outro musical content. In some embodiments, when a card is muted, the musical synthesis module 118 would not play the muted card for one turn and does not provide any score for one turn.

The above described techniques can be implemented in a distributed computing system that includes a back-end component, e.g., as a data server, and/or a middleware component, e.g., an application server, and/or a front-end component, e.g., a client computer or game console having a graphical player interface through which a player can interact with an example implementation, or any combination of such back-end, middleware, or front-end components. The components of the system can be interconnected by any form or medium of digital data communication, e.g., a communication network. Examples of communication networks include a local area network ("LAN") and a wide area network ("WAN"), e.g., the Internet, and include both wired and wireless networks.

The computing/gaming system can include clients and servers or hosts. A client and server (or host) are generally remote from each other and typically interact through a communication network. The relationship of client and server arises by virtue of computer programs running on the respective computers and having a client-server relationship to each other.

Those of skill in the art would appreciate that various illustrations described herein may be implemented as electronic hardware, computer software, firmware, or combinations of two or more of electronic hardware, computer software, and firmware. To illustrate this interchangeability of hardware, software, and/or firmware, various illustrative blocks, modules, elements, components, methods, and algorithms have been described above generally in terms of their functionality. Whether such functionality is implemented as hardware, software, firmware, or a combination depends upon the particular application and design constraints imposed on the overall system. Skilled artisans may implement the described functionality in varying ways for each particular application. Various components and blocks may be arranged differently (for example, arranged in a different order, or partitioned in a different way) all without departing from the scope of the subject technology. An implementation of the disclosed subject matter can be realized in a centralized fashion in one computer system, or in a distributed fashion where different elements are spread across several interconnected computer systems. Any kind of computer system, or other apparatus adapted for carrying out the methods described herein, is suited to perform the functions described herein.

A typical combination of hardware and software could be a general purpose computer system with a computer program that, when being loaded and executed, controls the computer system such that it carries out the methods described herein. The disclosed subject matter can also be embedded in a computer program product, which comprises all the features enabling the implementation of the methods and systems described herein, and which, when loaded in a computer system is able to carry out these methods.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form. Significantly, the systems and methods described herein may also be embodied in other specific forms without departing from the spirit or essential attributes thereof, and accordingly, reference should be had to the following claims, rather than to the foregoing specification, as indicating the scope of the systems and methods.

The present disclosure has been described in detail with specific reference to these illustrated embodiments. It will be apparent, however, that various modifications and changes can be made within the spirit and scope of the disclosure as described in the foregoing specification, and such modifications and changes are to be considered equivalents and part of this disclosure.

The invention claimed is:

1. An apparatus comprising:

a processor configured to run a computer program stored in memory, wherein the computer program is operable to cause the processor to:

identify a first object and at least one additional object placed on a music mix layout, retrieve, from a non-transitory memory device, a first musical container associated with the first object, wherein the first musical container comprises first musical content, and at least one additional musical container, each of the at least one additional musical container associated with one of the at least one additional object, wherein each of the at least one additional musical container comprises musical content, and generate a musical composition that plays musical sounds associated with the first musical content at the same time as musical sounds associated with the musical content of each of the at least one additional musical container.

2. The apparatus of claim 1, wherein the music mix layout comprises a physical music mix layout, and the apparatus further comprises an interface coupled to a sensor system, wherein the computer program is operable to cause the processor to receive, from the sensor system, via the interface, detection information indicating presence of the first object and the at least one additional object on the music mix layout.

3. The apparatus of claim 2, wherein the first object and the at least one additional object each comprise a passive radio element, and the sensor system comprises a radio signal detection system.

4. The apparatus of claim 3, wherein the radio signal detection system is configured to determine presence of the first object and the at least one additional object based, in part, on radio signals returned by the passive radio element of the first object and the passive radio element of the at least one additional object.

5. The apparatus of claim 2, wherein the first object and the at least one additional object each comprise a physical card.

6. The apparatus of claim 1, wherein the music mix layout comprises a virtual music mix layout.

7. The apparatus of claim 1, wherein the first musical content of the first object comprises predetermined melody samples.

8. The apparatus of claim 1, wherein the computer program is operable to cause the processor to determine a musical attribute associated with the at least one additional object, and to modify the musical composition based in part on the musical attribute.

9. The apparatus of claim 8, wherein the musical attribute comprises a tempo, and the computer program is operable to modify the musical composition by time-stretching the musical composition.

10. The apparatus of claim 8, wherein the musical attribute comprises a key, and the computer program is operable to modify the musical composition by transposing the musical composition.

11. The apparatus of claim 1, wherein the computer program is operable to cause the processor to repeat the musical sounds associated with the first musical content and to repeat the musical sounds associated with the musical content of each of the at least one additional musical container to repeat the musical composition.

12. The apparatus of claim 1, wherein the computer program is further operable to cause the processor to:

determine first one or more musical attribute values corresponding to first one or more musical attributes associated with the first object; and determine additional one or more musical attribute values corresponding to additional one or more musical attributes associated with each of the at least one additional object, wherein the musical composition is generated based in part on the first one or more musical attribute values and at least one of the additional one or more musical attribute values of the at least one additional musical container corresponding to musical attributes that are different from the first one or more musical attributes.

13. The apparatus of claim 12, wherein at least one of the additional one or more musical attribute values of the at least one additional musical container corresponding to musical attributes that are the same as the first one or more musical attributes are ignored during the generation of the musical composition.

14. The apparatus of claim 12, wherein the first one or more musical attributes and the additional one or more musical attributes associated with each of the at least one additional musical container comprise at least one of a type of musical content, a beat type, a bassline type, a melody, a sample type, an exclusive sample type, a genre, a meter, a measure of music, a tempo, a speed, a rhythm, a pitch, a harmony, a key, a mode, chord progression, a feel, a form, a verse, a chorus, or a bridge.

15. The apparatus of claim 12, wherein at least one of the first one or more musical attribute values and the additional one or more musical attribute values of each of the at least one additional musical container are received from a user via a controller.

16. A method comprising:

identifying, by a music synthesis module, a first object and at least one additional object placed on a music mix layout, retrieving, from a non-transitory memory device in communication with the music synthesis module, a first musical container associated with the first object, wherein the first musical container comprises first musical content, and at least one additional musical container, each of the at least one additional musical container associated with one of the at least one additional object, wherein each of the at least one additional musical container comprises musical content, and generating, by the music synthesis module, a musical composition that plays musical sounds associated with the first musical content at the same time as musical sounds associated with the musical content of each of the at least one additional musical container.

17. The method of claim 16, wherein the music mix layout comprises a physical music mix layout, and the method further comprises receiving, from a sensor system in communication with the music synthesis module, detection information indicating presence of the first object and the at least one additional object on the physical music mix layout.

18. The method of claim 17, wherein the first object and the at least one additional object each comprise a passive radio element, and the sensor system comprises a radio signal detection system.

19. The method of claim 16, further comprising determining a musical attribute associated with the at least one additional object, and modifying the musical composition based in part on the musical attribute.

20. The method of claim 16, further comprising:

determining first one or more musical attribute values corresponding to first one or more musical attributes associated with the first object; and determining additional one or more musical attribute values corresponding to additional one or more musical attributes associated with each of the at least one additional object, wherein the musical composition is generated based in part on the first one or more musical attribute values and at least one of the additional one or more musical attribute values of the at least one additional musical container corresponding to musical attributes that are different from the first one or more musical attributes.

21. A non-transitory computer readable medium comprising computer-executable instructions, wherein the instructions are operable to cause a processor to:

identify a first object and at least one additional object placed on a music mix layout, retrieve, from a non-transitory memory device in communication with the processor, a first musical container associated with the first object, wherein the musical container comprises first musical content, and at least one additional musical container, each of the at least one additional musical container associated with one of the at least one additional object, wherein each of the at least one additional musical container comprises musical content, and generate a musical composition that plays musical sounds associated with the first musical content at the same time as musical sounds associated with the musical content of each of the at least one additional musical container.

22. The non-transitory computer readable medium of claim 21, wherein the music mix layout comprises a physical music mix layout, and the instructions are further operable to cause the processor to receive, from a sensor system in communication with the processor, detection information indicating presence of the first object and the at least one additional object on the physical music mix layout.

23. The non-transitory computer readable medium of claim 21, wherein the instructions are further operable to cause the processor to determine a musical attribute associated with the at least one additional object, and modify the musical composition based in part on the musical attribute.

24. The non-transitory computer readable medium of claim 21, wherein the instructions are further operable to cause the processor to:

determine first one or more musical attribute values corresponding to first one or more musical attributes associated with the first object; and determine additional one or more musical attribute values corresponding to additional one or more musical attributes associated with each of the at least one additional object, wherein the musical composition is generated based in part on the first one or more musical attribute values and at least one of the additional one or more musical attribute values of the at least one additional musical container corresponding to musical attributes that are different from the first one or more musical attributes.

* * * * *